US006782839B1

(12) United States Patent
Nozaki

(10) Patent No.: US 6,782,839 B1
(45) Date of Patent: Aug. 31, 2004

(54) HYDROFOIL BOAT

(75) Inventor: Takeaki Nozaki, Osaka (JP)

(73) Assignee: Yanmar Diesel Engine Co., Ltd., Osaka (JP)

( * ) Notice: Subject to any disclaimer, the term of this patent is extended or adjusted under 35 U.S.C. 154(b) by 0 days.

(21) Appl. No.: 10/129,216

(22) PCT Filed: Oct. 30, 2000

(86) PCT No.: PCT/JP00/07655

§ 371 (c)(1),
(2), (4) Date: Sep. 4, 2002

(30) Foreign Application Priority Data

Nov. 1, 1999 (JP) ..... H11-311650

(51) Int. Cl.[7] ..... B63B 1/30
(52) U.S. Cl. ..... 114/282; 114/280; 114/291
(58) Field of Search ..... 114/271, 274, 114/280, 281, 282, 288, 289, 290, 291, 61.1

(56) References Cited

U.S. PATENT DOCUMENTS

| | | | | | |
|---|---|---|---|---|---|
| 1,665,149 | A | * | 4/1928 | Van Wienen | 114/284 |
| 1,720,167 | A | * | 7/1929 | Clifton | 114/291 |
| 2,601,836 | A | * | 7/1952 | Crewe | 114/284 |
| 3,117,546 | A | * | 1/1964 | Von Schertel | 114/277 |
| 3,150,626 | A | * | 9/1964 | Irgens | 114/282 |
| 3,477,400 | A | * | 11/1969 | Walker | 114/274 |
| 3,498,248 | A | * | 3/1970 | Van Bibber | 114/274 |
| 4,748,929 | A | * | 6/1988 | Payne | 114/280 |
| 4,756,265 | A | * | 7/1988 | Lane | 114/57 |
| 5,339,761 | A | * | 8/1994 | Huang | 114/274 |
| 6,042,052 | A | * | 3/2000 | Smith | 244/105 |
| 6,164,235 | A | * | 12/2000 | Hoppe | 114/275 |

FOREIGN PATENT DOCUMENTS

| | | | | | |
|---|---|---|---|---|---|
| JP | 56-11193 | | | 7/1954 | |
| JP | 58-188288 | | | 12/1983 | |
| JP | 05319359 | A | * | 12/1993 | B63B/1/24 |
| JP | 06092285 | A | * | 4/1994 | B63B/1/18 |
| JP | 07267176 | A | * | 10/1995 | B63B/1/18 |
| JP | 07267177 | A | * | 10/1995 | B63B/1/24 |
| JP | 07267178 | A | * | 10/1995 | B63B/1/24 |
| JP | 09-207872 | | | 8/1997 | |
| JP | 09207872 | A | * | 8/1997 | B63B/1/28 |
| JP | 09-286390 | | | 11/1997 | |
| JP | 2000033899 | A | * | 2/2000 | B63B/1/30 |
| JP | 2001130478 | A | * | 5/2001 | B63B/1/30 |

* cited by examiner

*Primary Examiner*—S. Joseph Morano
*Assistant Examiner*—Ajay Vasudeva
(74) *Attorney, Agent, or Firm*—Knobbe, Martens, Olson & Bear LLP

(57) ABSTRACT

A hydrofoil (1) comprises a bottom (23) formed with two front and rear steps (3 and 4), and a strut (31) supporting a submerged hydrofoil (21) arranged between the two steps (3 and 4). The strut (31) can be switched between a storage state and a navigation state by its forward-and-backward rotation. A threshold value of dynamic lift (F) obtained by the hydrofoil (21) can be established arbitrarily, and the dynamic lift can be held to the set value by keeping the strut (31) in the navigation state correspondingly to the established threshold value of hydrofoil-dynamic-lift, thereby enabling the dynamic lift to be held at the established value during navigation. Moreover, based on draft (WL) or trim angle (TR) during the boat-berthing, a set value of hydrofoil-dynamic-lift and a set value of tilt angle of a propulsor (22) or a flap (22*a*) attached to the rear of hull can be accommodated.

22 Claims, 19 Drawing Sheets

(a)

(b)

(a)

(b)

HYDROFOIL BOAT

This application is the U.S. National Phase under 35 U.S.C. §371 of International Application PCT/JP00/07655, filed Oct. 30, 2000, which claims priority to Japanese Patent Application No. 11/311650, filed Nov. 1, 1999. The International Application was published under PCT Article 21(2) in a language other than English.

TECHNICAL FIELD

This invention relates to a hydrofoil boat of which hull and whole-submerged hydrofoil generate a dynamic lift for navigation.

BACKGROUND ART

Conventionally, a well-known hydrofoil boat has a deep front bottom and a shallow rear bottom that are distinguished from each other by forming a single step in the bottom, wherein a strut projects downward from the rear of front bottom so as to support a hydrofoil. For example, it is disclosed in JP,9-207872,A. In this disclosed art, the hydrofoil is a whole-submersed hydrofoil arranged deeper than the rear end of front bottom. While a boat is hydroplaning, rear ends of the respective front and rear bottoms serve as skid surfaces touching the water surface, and the submerged hydrofoil generates a dynamic lift for supporting, thereby reducing drag. This dynamic lift is controlled to be fixed for acquiring stability of navigation. High hydroplaning capacity can be acquired by enlarging a rate of dynamic lift loaded on the hydrofoil (a degree of mass supported by the dynamic lift of hydrofoil in the whole mass of a boat, which is expressed with a hydrofoil-dynamic-lift/boat-mass.).

However, the dynamic lift of the hydrofoil must be decided considering its relation to a centroid of the boat in connection with navigation stability, wherein the problem about the conventional hydrofoil boat having the single-stepped bottom exists. This problem will be explained in accordance with FIGS. 1 and 2. FIG. 1 illustrates schematic side views of a hydrofoil boat 1' showing variation of pressure distribution and trim moment situation caused by the difference of the rate of dynamic lift loaded on the hydrofoil. FIG. 1(*a*) is the view when the rate of dynamic lift loaded on the hydrofoil is small, FIG. 1(*b*) is the view when it is fair, and FIG. 1(*c*) is the view when it is large. FIG. 2(*a*) is a schematic side view of conventional hydrofoil boat 1' with a single-stepped bottom, showing an optimal centroid Gi when the hydrofoil is put at its navigation position, and FIG. (b) is a schematic view of the same, showing optimal centroid position Gi when there is no hydrofoil.

In hydrofoil boat 1' shown in FIGS. 1 and 2, which has the single step as mentioned above formed in the bottom thereof, a hydrofoil 21 is arranged ahead of a step 1'*a* because it is stored so as to fit step 1'*a*. Therefore, a dynamic lift is generated at this position. This dynamic lift is desired to be close to the boat-centroid as much as possible. The reason is that, if the dynamic-lift generating position is far forward from the boat-centroid, porpoising occurs easily, and if it is far rearward, yawing occurs easily.

However, in the conventional hydrofoil boat having the single-stepped bottom exists such a problem that the centroid moves rearward with the increase of hydrofoil-dynamic-lift so as to raise a trim angle extremely. If hydrofoil boat 1' having the single-stepped bottom shown in FIG. 1 is put in a state where a hydrofoil-dynamic-lift F (correctly, a rate of dynamic lift loaded on the hydrofoil) is small as shown in FIG. 1(*a*), a boat-centroid G is arranged just ahead of step 1'*a* so as to approach the position of hydrofoil-dynamic-lift. The front bottom section and the rear bottom section receive pressure from the water level surface so as to generate a pressure-distribution Pf in the front bottom section, and a pressure-distribution Pr in the rear bottom section. This pressure interacts as a force for supporting the boat. In the state of (a), a great distance between both pressure-distributions Pf and Pr is assured, and a trim moment Tm which interacts for balancing the boat in the length thereof is assured greatly.

However, as the hydrofoil-dynamic-lift is enlarged as shown in FIG. 1(*b*) and (*c*), pressure-distribution Pf in the front bottom section moves backward toward step 1'*a* while pressure-distribution Pr in the rear bottom section hardly moves because it is in a stem, whereby the trim angle is increased. In the state of (c), pressure distribution Pf in the front bottom section almost laps with the dynamic-lift generating position so that trim moment Tm becomes extremely small, whereby the boat remains tilting backward, i.e., porpoising.

Moreover, FIG. 2(*a*) shows hydrofoil boat 1' provided with the hydrofoil, and FIG. 2(*b*) shows it having no hydrofoil. However, the state of (a) may be transposed to hydrofoil boat 1' having hydrofoil 21 set at a navigating position, and the state of (b) to it having hydrofoil 21 stored. As shown in FIG. 2(*a*), when hydrofoil 21 is set to the navigating position, an optimal centroid Gi is arranged ahead of step 1'*a* so as to be close to hydrofoil 21, i.e., the dynamic-lift generating position. However, since there is no support by the hydrofoil-dynamic-lift when hydrofoil 21 is stored, pressure-distribution Pf in the front bottom section comes ahead and the boat tilts forward so that optimal centroid Gi moves rearward, as indirectly shown in FIG. 1(*a*). In the state of (b), it is located more rearward than step 1'*a*. When there are many loads, optimal centroid Gi when the hydrofoil being stored comes further rearward. However, if a boat-centroid G is established according to such optimal centroid Gi when the hydrofoil being stored, actual boat-centroid G will separate from optimal centroid Gi back increasingly during navigation, and the above faults will be brought about.

In order to avoid such porpoising in navigation, the hydrofoil-dynamic-lift must be set small. Consequently, the boat has not been able to acquire sufficient hydroplaning capacity.

DISCLOSURE OF THE INVENTION

A hydrofoil boat having a whole-submerged hydrofoil according the present invention comprises a couple of front and rear steps formed in a bottom thereof, and comprises a strut supporting a hydrofoil arranged between the pair of steps. In this way, the fluctuation of a trim angle accompanying the variation of hydrofoil-dynamic-lift is inhibited so as to prevent a gap between a boat-centroid and a dynamic-lift generating position which is as much as to generate porpoising. Therefore, high hydrofoil-dynamic-lift can be established, whereby the boat can acquire sufficient hydroplaning capacity. Moreover, even if the centroid is fluctuated by variation of the loading weight etc., the fluctuation is so small as to maintain the centroid adjacent to the dynamic-lift generating position, whereby the trim angle is not fluctuated greatly. Thus, high hydrofoil-dynamic-lift can be established in the same way, thereby effecting enough reduction of drag.

Moreover, in the hydrofoil boat of the present invention, the hydrofoil is rotated forward and rearward so that the position thereof may be changed between a storage position and a navigation position. The hydrofoil can be fixed in the navigating position corresponding to the variation of hydrofoil-dynamic-lift. Accordingly, as mentioned above, the hydrofoil-dynamic-lift can be kept constant so as to acquire stability in navigation, as well as it can be set to be high as mentioned above.

Furthermore, the hydrofoil boast of the present invention can adjust the hydrofoil-dynamic-lift and a tilt angle of a propulsor or a flap disposed on the rear of hull, corresponding to draft or the trim angle when the boat berths. That is, even if the mass of boat changes by variation of loading weight, the hydrofoil-dynamic-lift can be accommodated and established so as to hold the rate of dynamic lift loaded on the hydrofoil constant. Therefore, the boat can acquire the best reduction of drag corresponding to the boat-mass that varies at any time. Further, it can acquire an optimal propelling force corresponding to the fluctuation of trim and draft by adjusting the set angle of the propulsor or the flap. In this way, the present invention serves as a hydrofoil boat having high hydroplaning capacity.

BEST MODE FOR CARRYING OUT THE INVENTION

Figure 3:
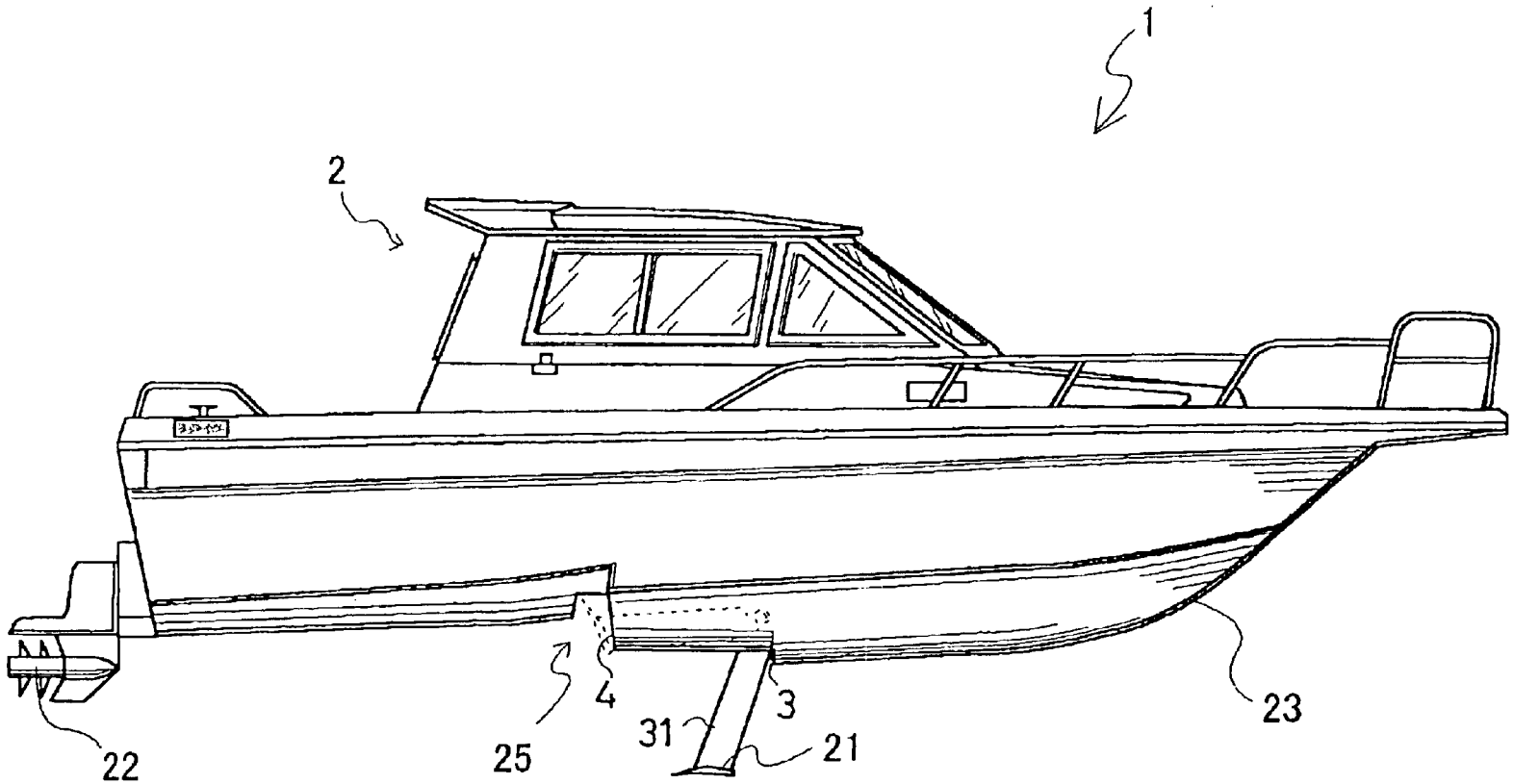
FIG. 3 is a whole side view of a hydrofoil boat having a double-stepped bottom according to the present invention.
Figure 4:
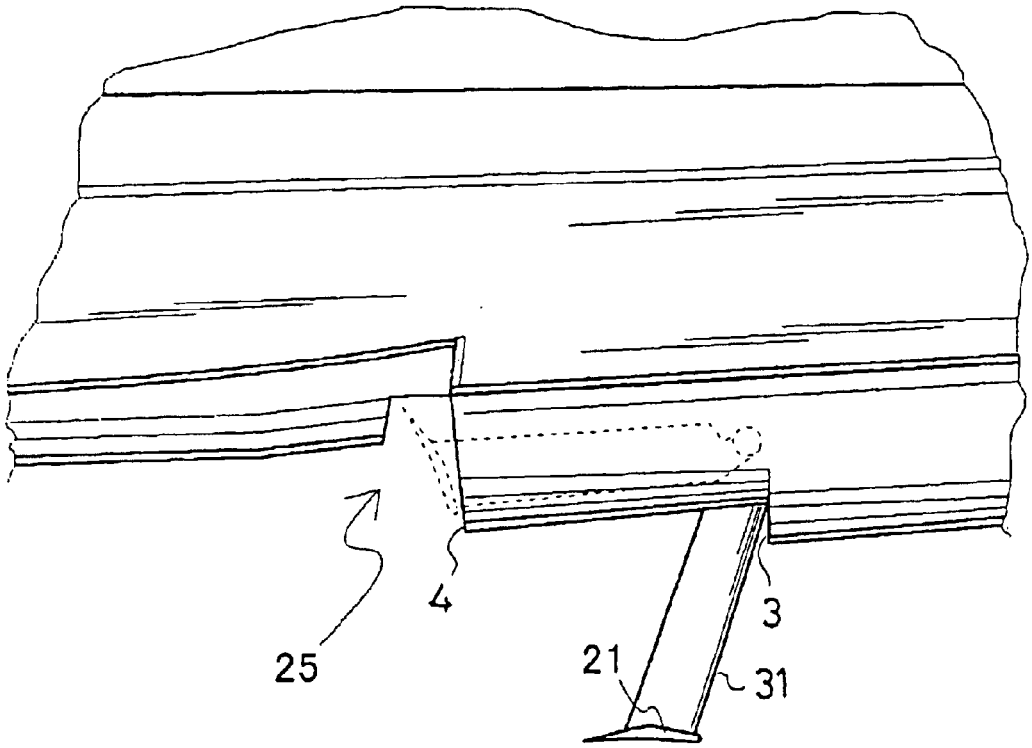
FIG. 4 is an enlarged fragmentary side view of a stepped portion of the bottom of the hydrofoil boat according to the present invention.

As shown in FIGS. 3 and 4, a hydrofoil boat 1 according to the present invention is provided at an upper portion thereof with a boarding section 2, below which a bottom 23 is arranged.

A propulsor 22 is arranged at a stem of hydrofoil boat 1, and a hydrofoil 21 is arranged at bottom 23. Propulsor 22 is actuated with an engine (engine 10 shown in FIG. 12 etc.) arranged in the hull. Hydrofoil 21 is of a whole-submerged type, and is supported on a tip of a hydrofoil-strut 31. Hydrofoil-strut 31 is attached to bottom 23 so that it can be rotated forward and rearward by a hydraulic cylinder (a later-discussed control cylinder 34). Hydrofoil 21 can be put into a navigation state (tilt down) as fill lines drawn in FIGS. 3 and 4, where it projects downward, and into a storage state (tilt rise) as dotted lines, where it is arranged approximately horizontally.

Hydrofoil boat 1 can generate a dynamic lift by propelling with hydrofoil-strut 31 projecting downward. Whereby, bottom 23 comes to float from the sea surface so as to reduce the contact area thereof with the sea surface, thereby reducing the drag of water which bottom 23 receives. Therefore, the propelling force generated by propulsor 22 arranged at the stem is utilized effectively so as to raise the propelling speed efficiently.

Figure 8:
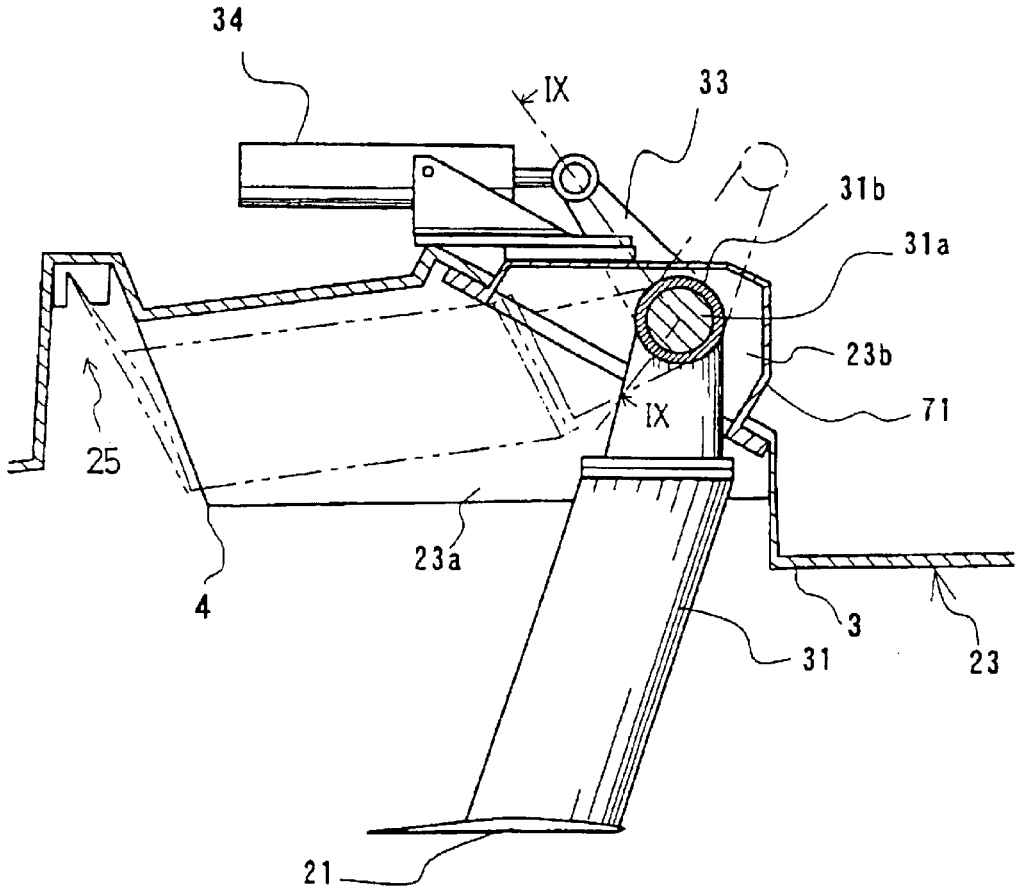
FIG. 8 is a sectional side view of a mechanism for supporting the hydrofoil.

Generally, bottom 23 comprises a deep front bottom section and a shallow bottom rear section. Furthermore, as shown in FIG. 8, a bottom section of middle depth which has a storage recess 23*a* as a longitudinal groove. A first step 3 is formed between the front bottom section and the middle bottom section, and a second step 4 between the middle bottom section and the rear bottom section. Furthermore, an upward storage recess 25 is formed continuously rearward from second step 4 serving as the rear end of the middle bottom section. That is, storage recess 25 is formed shallowly in a degree in the front end of the rear bottom section.

A pivot end (serving as a top end when navigation, and a front end when storage) of hydrofoil-strut 31 is arranged just behind first step 3. When the boat is moored to a port or the depth of water is reduced, hydrofoil-strut 31 is rotated rearward so as to prevent hydrofoil 21 from hitting the seabed, so that hydrofoil-strut 31 is inserted into storage recess 23*a* and hydrofoil 21 into storage recess 25 behind second step 4, as two-dot chain lines drawn in FIG. 8, whereby they are stored. In the navigation state where hydrofoil-strut 31 is taken down, hydrofoil-strut 31 and hydrofoil 21 are arranged between first and second steps 3 and 4 in the longitudinal direction of the boat.

Such formation of two front and rear steps 3 and 4 in bottom 23 and arrangement of hydrofoil 21 between steps 3 and 4 effects restriction of centroid-fluctuation, and maintenance of appropriate trim moment in spite of increase of dynamic lift. This will be described in accordance with FIGS. 5 to 7.

Figure 5:
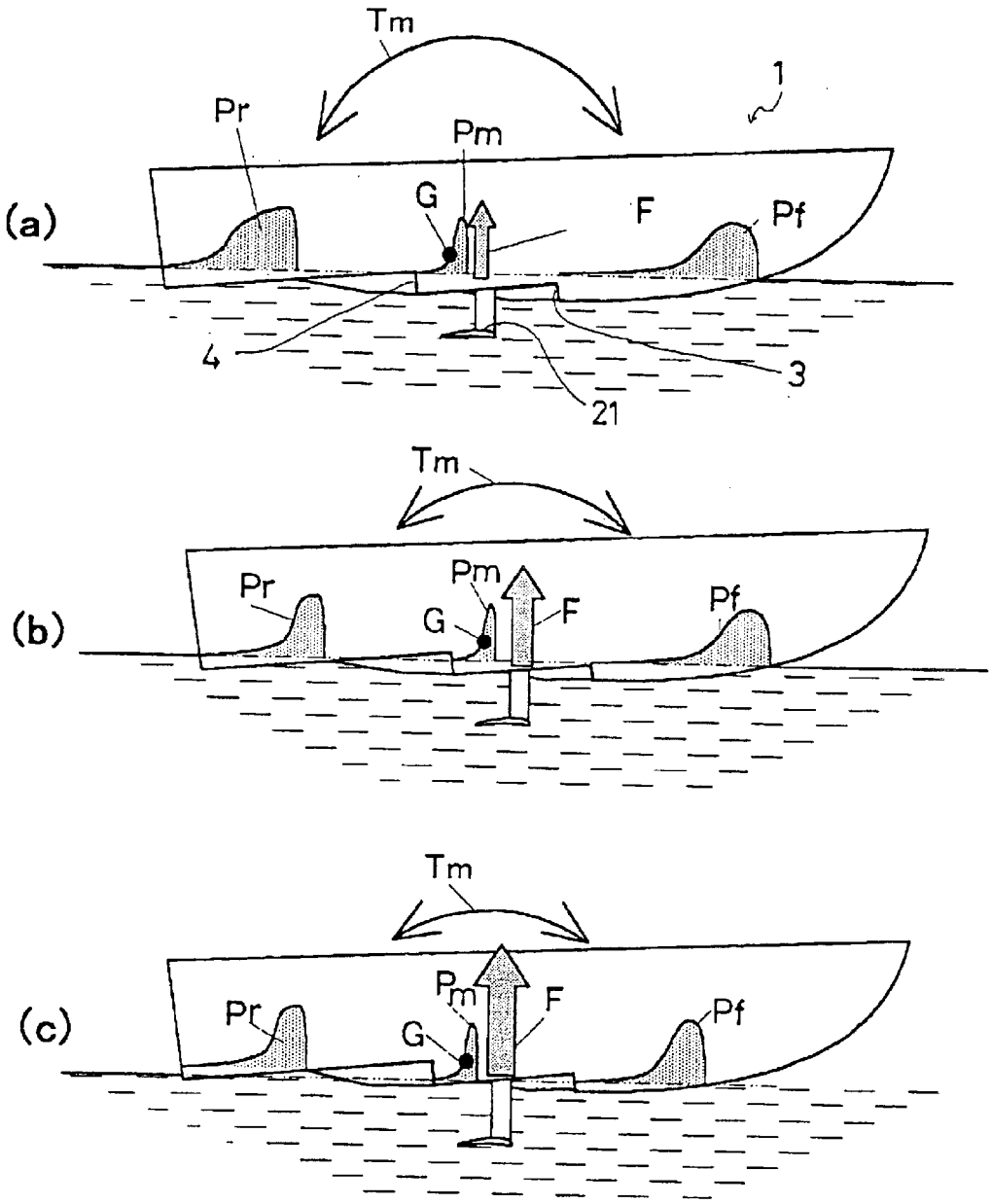
FIG. 5 illustrates schematic views of a hydrofoil boat having a single-stepped bottom according to the present invention, notionally showing fluctuations of pressure-distributions and trim moment generation caused by variation of a rate of dynamic lift loaded on the hydrofoil, wherein (a) is the view when the rate of dynamic lift loaded on the hydrofoil is small, (b) is the view when it is fair, and (d) is the view when it is large.

As shown in FIG. 5, by forming first and second steps 3 and 4 in bottom 23 and arranging hydrofoil 21 between both steps 3 and 4, reduction of the trim moment is held down in spite of increase of the hydrofoil-dynamic-lift. That is, if the trim moment becomes smaller than a fixed limit, the boat porpoises (or yaws) so as not to navigate stably. However, hydrofoil 21 of the present invention always conserves larger trim moment than the fixed limit because of the double-stepped bottom thereof.

Figure 1:
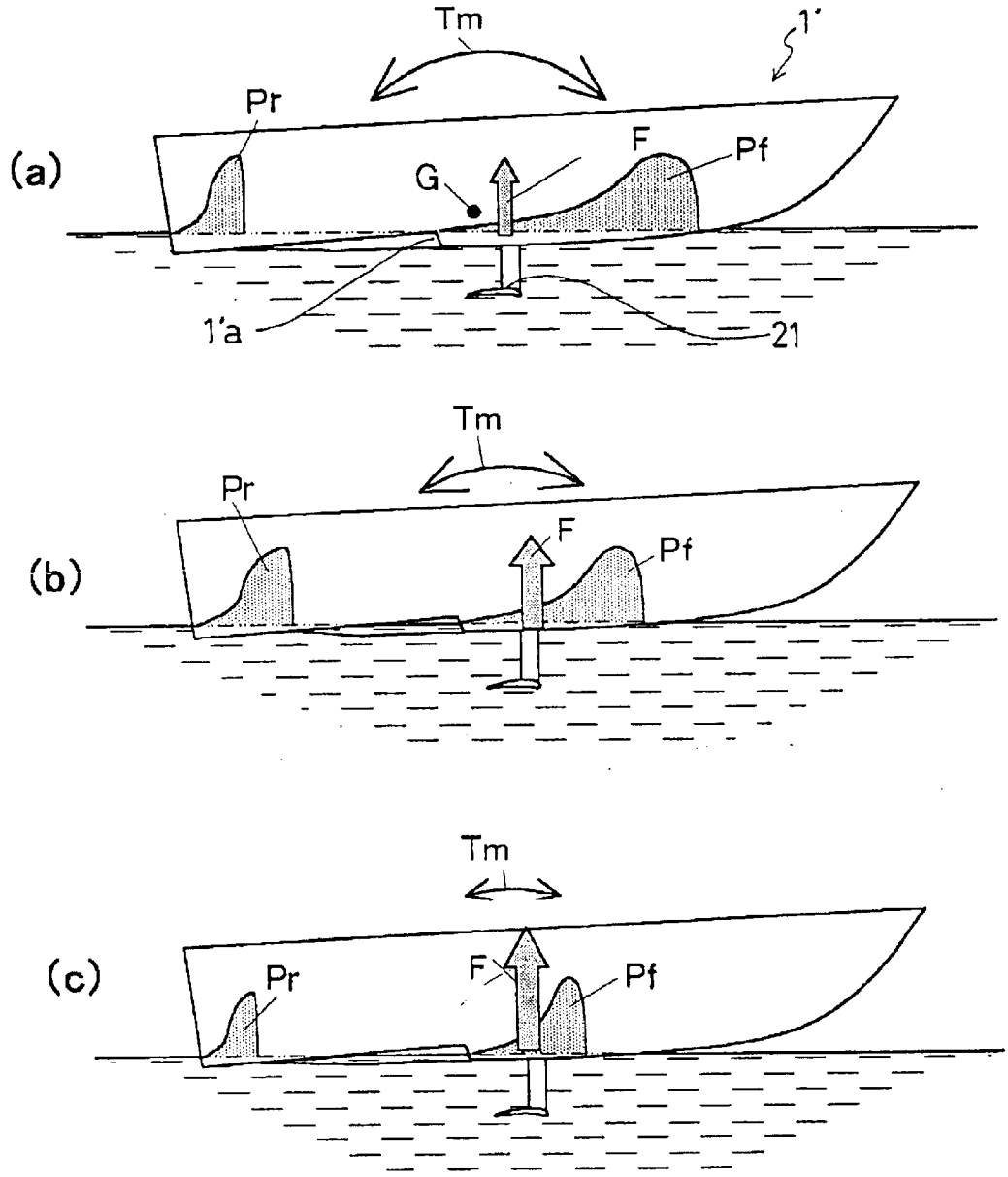
FIG. 1 illustrates schematic views of a conventional hydrofoil boat having a single-stepped bottom, notionally showing fluctuations of pressure-distributions and trim moment generation caused by variation of a rate of dynamic lift loaded on the hydrofoil, wherein (a) is the view when the rate of dynamic lift loaded on the hydrofoil is small, (b) is the view when it is fair, and (d) is the view when it is large.
Figure 2:
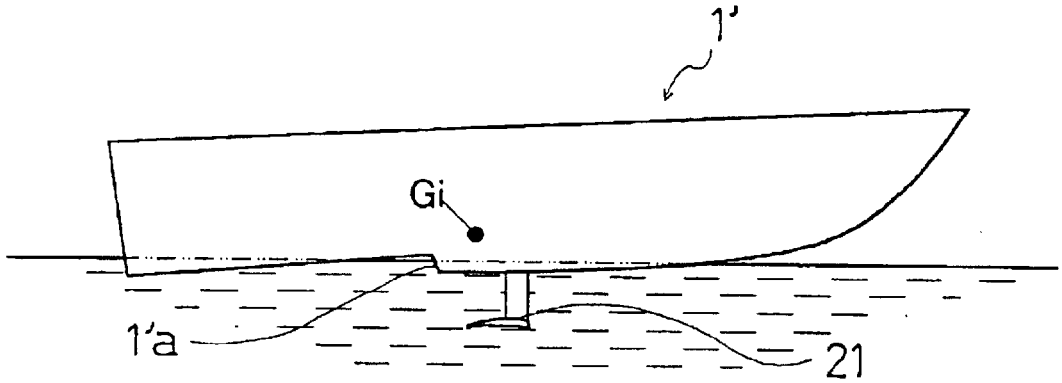
FIG. 2 illustrates schematic views of the conventional hydrofoil, notionally showing optimal centroids, wherein (a) is the view when a hydrofoil is set at a navigation position, and (b) is the view when the boat has no hydrofoil.
Figure 2:
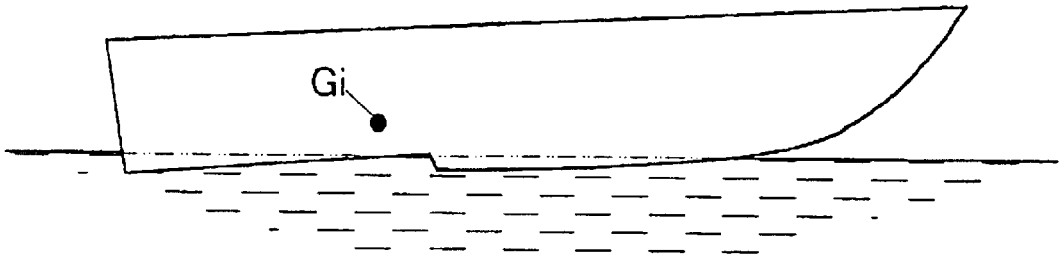

As shown in FIG. 5(*a*), when a dynamic lift F (correctly, it is a rate of loaded dynamic-lift. It is the same in following references to FIGS. 5, 6 and 7) is small, the front and rear bottom sections receive pressure from the water surface so as to get pressure-distributions Pf and Pr, respectively, and a small pressure-distribution Pm is generated immediately adjacent to (Oust behind) the dynamic-lift generating position in the middle bottom section between pressure-distributions Pf and Pr. This pressure-distribution Pm hardly varies even if dynamic lift F increases as shown in FIGS. 5(*b*) and (*c*). Moreover, pressure-distribution Pr in the rear bottom section does not move greatly in spite of variation of dynamic lift F because it is in the stem. In the conventional case, as shown in FIG. 1(*c*) and mentioned above, pressure-distribution Pf in the front bottom section moves rearward to the dynamic-lift generating position according to increase of dynamic lift F. However, according to the present invention, even if pressure-distribution Pf moves the most backward as shown in FIG. (c), it is kept ahead of the dynamic-lift generating position by front step 3 so as not to reach the dynamic-lift generating position. Therefore, even if dynamic lift F becomes large, big pressure-distributions Pf and Pr are maintained in front and rear portions of bottom 23, respectively, so as to sandwich the position where dynamic lift F generates. Thus, trim moment Tm does not become extremely small.

Even if a bottom-centroid G is established just behind the dynamic-lift generating position as shown in (a) and dynamic lift F becomes large as shown in (b) and (c), centroid G established in the state of (a) hardly moves because the trim angle does not increase extremely. Moreover, even if the rate of dynamic lift loaded on the hydrofoil is 0 (i.e., hydrofoil 21 is stored), there is almost no fluctuation of the centroid.

Figure 6:
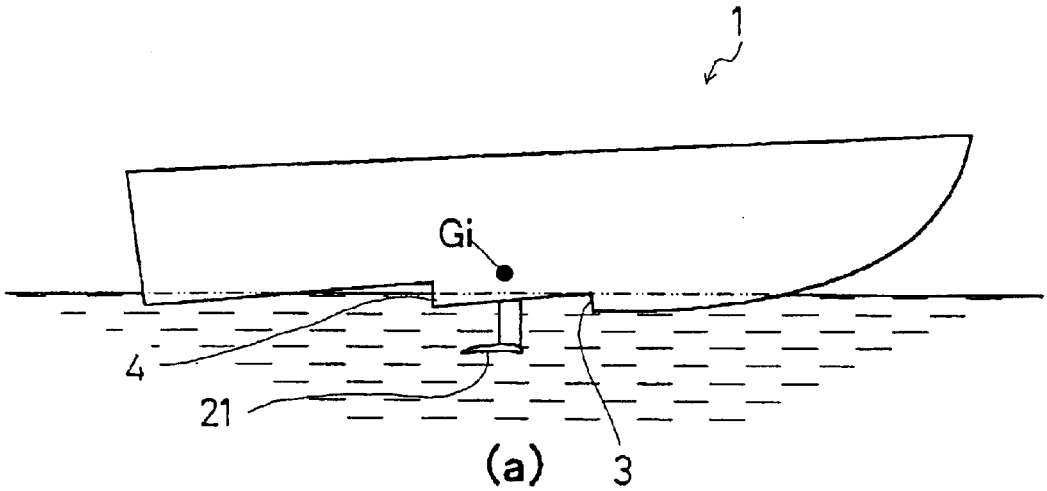
FIG. 6 illustrates schematic side views of the hydrofoil boat according to the present invention, wherein (a) is the view when the hydrofoil is set at a navigation position, and (b) is the view when there is no hydrofoil.
Figure 6:
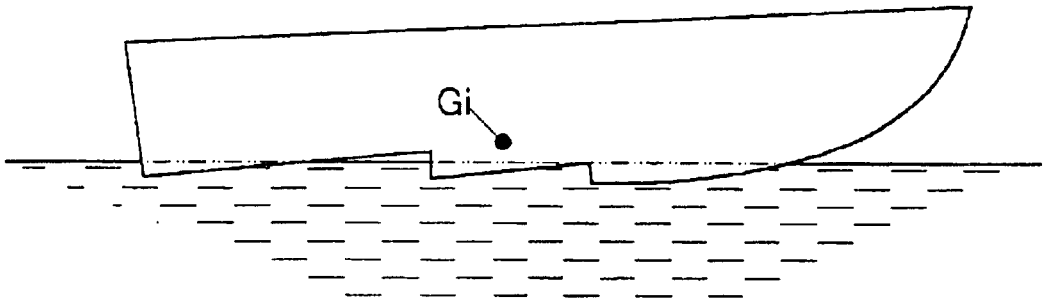

As shown in FIG. 6(*a*), when hydrofoil 21 is set in the navigation state, an optimal centroid Gi of hydrofoil boat 1 is in the middle bottom section just behind the dynamic-lift generating position, i.e., between both steps 3 and 4, in order to avoid porpoising and yawing. On the other hand, even when hydrofoil 21 is folded (similarly to the state where there is no hydrofoil), as shown in (b), optimal centroid Gi is still in the middle bottom section, i.e., between steps 3 and 4, because pressure-distribution Pm generates in the middle bottom section so as to serve as a boat-support force. This is hardly moved from optimal centroid Gi in navigation. Even if the weight of loads is increased, optimal centroid Gi does not move greatly and does not reach behind step 4. Therefore, if boat-centroid G is established so as to coincide with optimal centroid Gi when hydrofoil 21 is stored, hull-centroid G is hardly separated from optimal centroid Gi even if hydrofoil 21 is put into the navigation state and receives dynamic lift F. Thus, good balance can be conserved in the forward-and-rearward direction.

Figure 7:
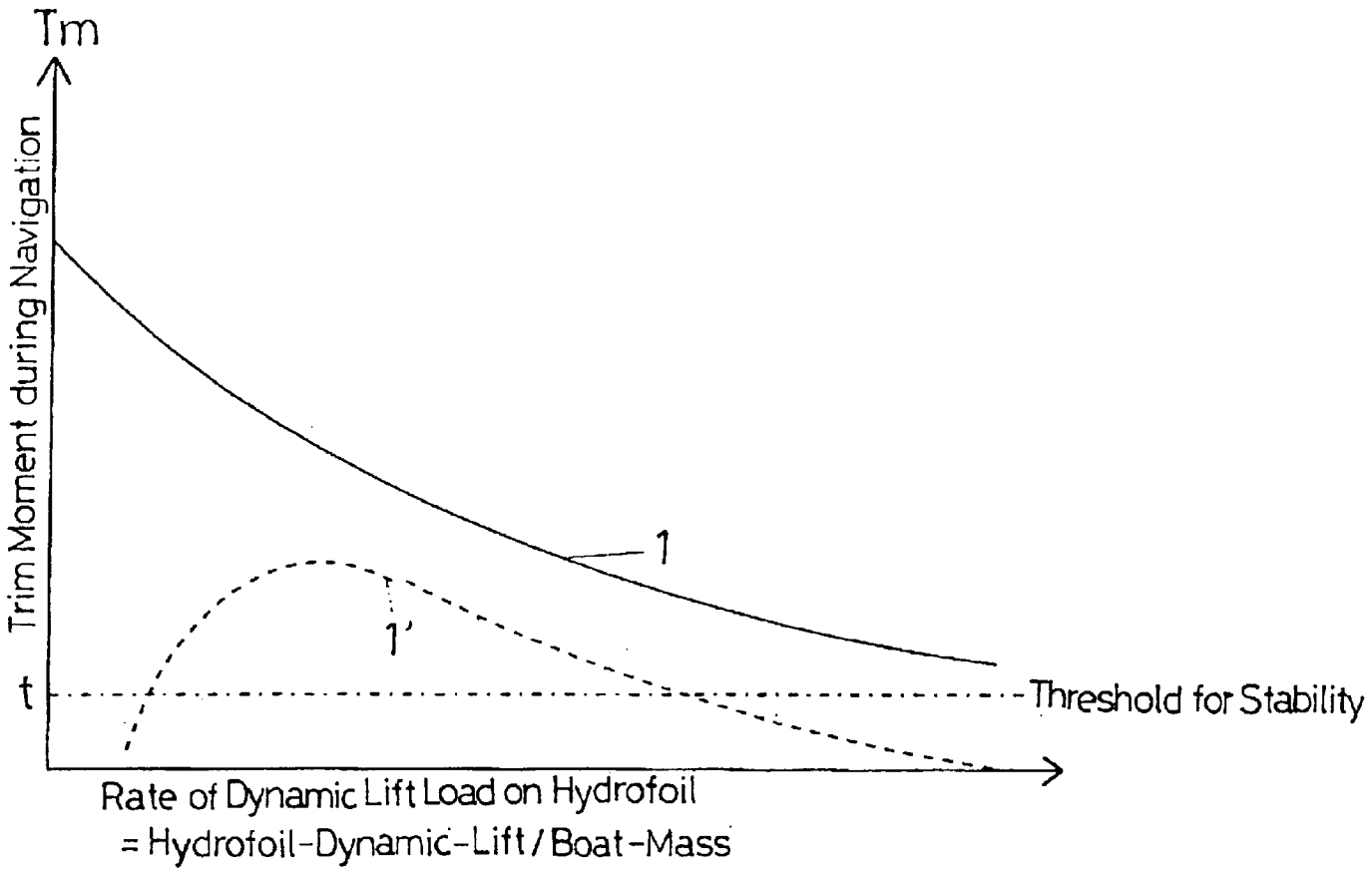
FIG. 7 is a correlation diagram of the trim moment and the rate of dynamic lift loaded on the hydrofoil in the conventional type hydrofoil boat and the hydrofoil boat of the present invention.

As shown in FIG. 7, a limit-of-stability value t serving as a value of trim moment Tm is established so that, when trim moment Tm becomes smaller than established value t, porpoising or yawing occurs so as to make navigation unstable. In conventional hydrofoil boat 1', boat-centroid G is previously established so as to approach the dynamic-lift generating position as much as possible. Therefore, in the state where dynamic lift F is zero (including the storage state) or very small, boat-centroid G separates considerably forward from optimal centroid Gi of FIG. 1(*b*) so that trim moment Tm becomes extremely small so as to be less than limit-of-stability value t. However, this case is when the boat is berthing or crawling. In this case, the trim still does not become so important concerning navigation. The problem arises in the case where dynamic lift F is enlarged. In conventional hydrofoil boat 1', if dynamic lift F becomes more than f, trim moment Tm is reduced to be less than lit-of-stability t according to such a fluctuation of pressure-distribution as shown in FIG. 1(*c*). Consequently, conventional hydrofoil boat 1' with the single-stepped bottom cannot make the hydrofoil-dynamic-lift more than f. Therefore, even in the case where the trim angle is large, the hydrofoil-dynamic-lift cannot be large enough to get desirable hydroplaning corresponding to the large trim angle.

On the other hand, as described referring to FIG. 6, in hydrofoil boat 1 of the present invention, whether it is in navigation or has the hydrofoil stored, optimal centroid Gi hardly moves so that the centroid established to coincide with the optimal centroid in navigation is still correspondent to the optimal centroid when hydrofoil-stored. Therefore, as shown in FIG. 7, when dynamic lift F is zero or extremely small, large trim moment Tm is ensured. Furthermore, according to increase of dynamic lift F, the pressure-distributions move as shown in FIGS. 5(*b*) and (*c*) so that trim moment Tm is reduced. However, since the fluctuation of pressure-distribution Pf in the front bottom section is especially restricted, trim moment Tm does not become less than limit-of-stability value t even when dynamic lift F is increased to the limit thereof concerning hydrofoil 21. Therefore, the set value of dynamic lift can be free from being held undesirably small. If the trim angle is increased, the dynamic lift can be set large correspondingly to it, thereby giving good hydroplaning capacity.

Figure 9:
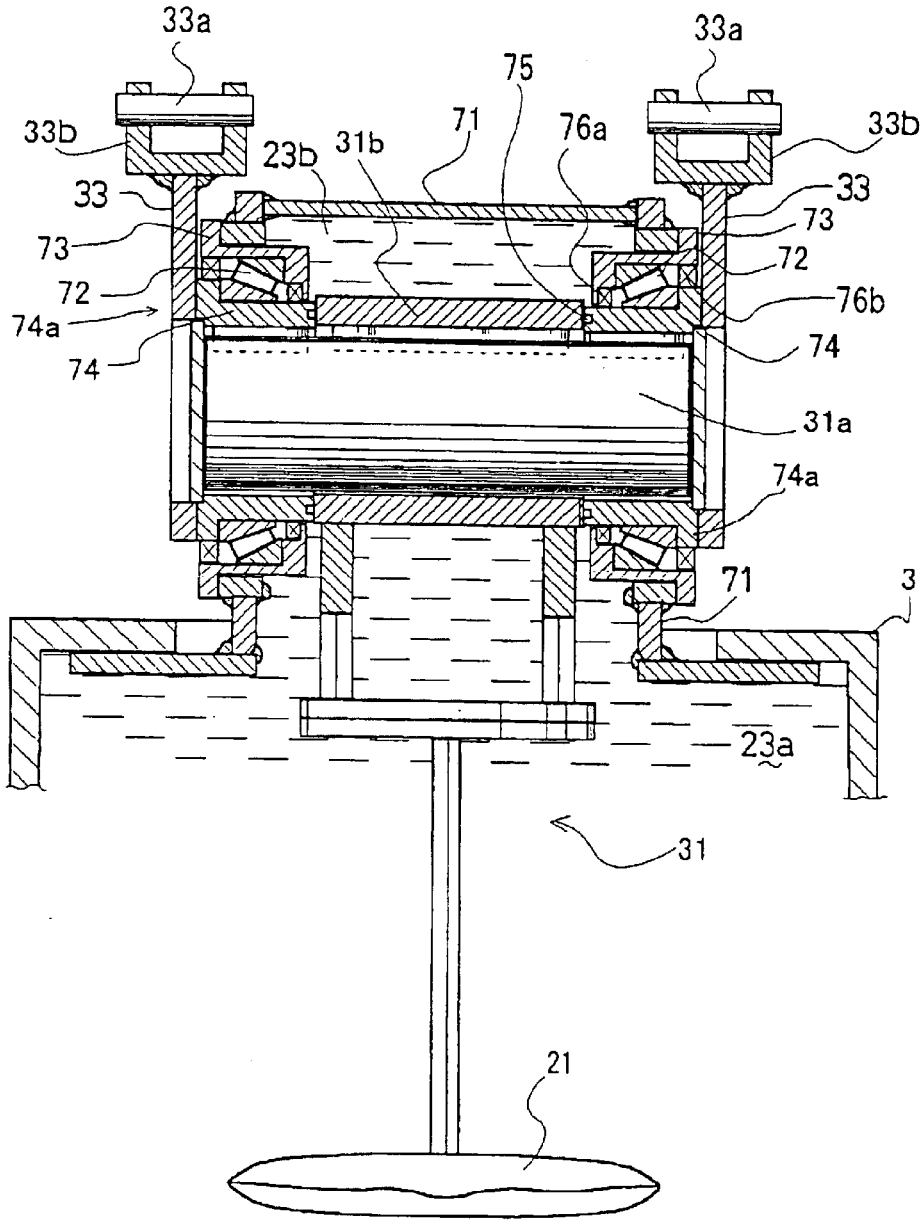
FIG. 9 is a cross sectional view taken along IX—IX line of FIG. 8.

Description will now be given of a driving mechanism for rotation of hydrofoil-strut 31 shown in FIGS. 8 and 9. A housing 71, which contains the pivot portion of hydrofoil-strut 31, is arranged just behind first step 3, i.e., in a front portion of storage recess 23*a* in the middle bottom section, and fixed to bottom 23 by welding. Housing 71 is open at the lower rear portion thereof so as to allow hydrofoil-strut 31 to rotate. A space enclosed by housing 71 serves as a recess 23*b* for rotation, in which the base end of hydrofoil-strut 31 is rotated.

Within rotation recess 23*b* is arranged a laterally axial rotary shaft 31*a* so as to be rotatable around its axis as discussed later. As shown in FIG. 9, a boss 31*b* fixed on the upper portion of hydrofoil-strut 31 is not-relatively rotatably attached to rotary shaft 31*a* through a key. Therefore, by rotating rotary shaft 31*a* about its axis, hydrofoil-strut 31 rotates integrally with it vertically (or longitudinally) centering on rotary shaft 31*a*.

Both ends of rotary shaft 31*a* pass through circular openings in left and right side surface portions of housing 71, respectively, so as to project from recess 23*b* into the interior of the hull. Sleeves 74 are not-relatively rotatably provided around the respective left and right end portions of rotary shaft 31*a* through keys.

Each sleeve 74 is formed on the outer end thereof with a flange portion 74*a* outside each of the left and right side surfaces of housing 71, i.e., in the interior of the hull. A couple of left and right arms 33 are fixed to respective flange portions 74*a*. A bracket 33*b* is fixed to a top end of each arm 33, and a pivot pin 33*a* is laterally inserted into bracket 33*b*.

On the other hand, a couple of left and right hydraulic control cylinder 34 are arranged in approximately forward-and-backward direction above a ceiling of storage recess 23*a* in the middle bottom section. Piston rods of cylinders 34 are extended forward and pivotally supported at front ends thereof onto respective pivot pins 33*a*. In this way, both arms 33 are rotated by telescopic motion of the piston rods of both control cylinders 34 so as to integrally rotate rotary shaft 31 a and hydrofoil-strut 31. As a two-dotted line drawn in FIG. 8, by elongating the piston rod, hydrofoil 21 and hydrofoil-strut 31 are folded. By contracting the piston rod, hydrofoil-strut 31 is made to project below so as to set hydrofoil 21 into the navigating position.

A bearing cover 73 is annularly arranged on the periphery of each sleeve 74, and it is fixed to the edge of the circular opening in each of the left and right side surface portions of housing 71. A bearing 72 is interposed between each bearing cover 73 and each sleeve 74. In this embodiment, in order to receive both a radial force from the outer peripheral surface of sleeve 74 and a thrust force from flange portion 74*a*, each bearing 72 is a tapered-roller bearing. However, any bearing is acceptable only if it is made to receive both the forces.

In this way, the left and right side surface portions of housing 71 pivotally support respective sleeves 74 fixed on left and right ends of rotary shaft 31*a* through respective left and right bearings 72, thereby supporting rotary shaft 31*a* onto the hull so as to make it rotatable centering on axis thereof.

Incidentally, although external water flows into recess 23*b*, each of seal members 76*a* and 76*b* is interposed between each sleeve 74 and each bearing cover 73 so as to seal the portion where each bearing 72 is arranged. Furthermore, due to this, the external water is prevented from permeating the hull, thereby ensuring the waterproofness of control cylinders 34. Moreover, an O-ring 75 is interposed between each sleeve 74 and boss 31*b* so as to prevent water from permeating the gap therebetween to rotary shaft 31*a*, thereby assuring the durability of rotary shaft 31*a*.

Thus, since waterproofness is achieved, bearings 72 and control cylinders 34 can be made cheaply without considering corrosion resistance. Control cylinders 34 are entirely arranged within the hull. Therefore, their installation and maintenance are easy, and they can be degassed even if hydrofoil boat 1 is on the sea. Also, in a whole of hydrofoil controlling mechanism 26, there are few parts in contact with water so that members which do not contact water can omit waterproofing, thereby enabling the whole manufacturing costs to be kept down.

Figure 10:
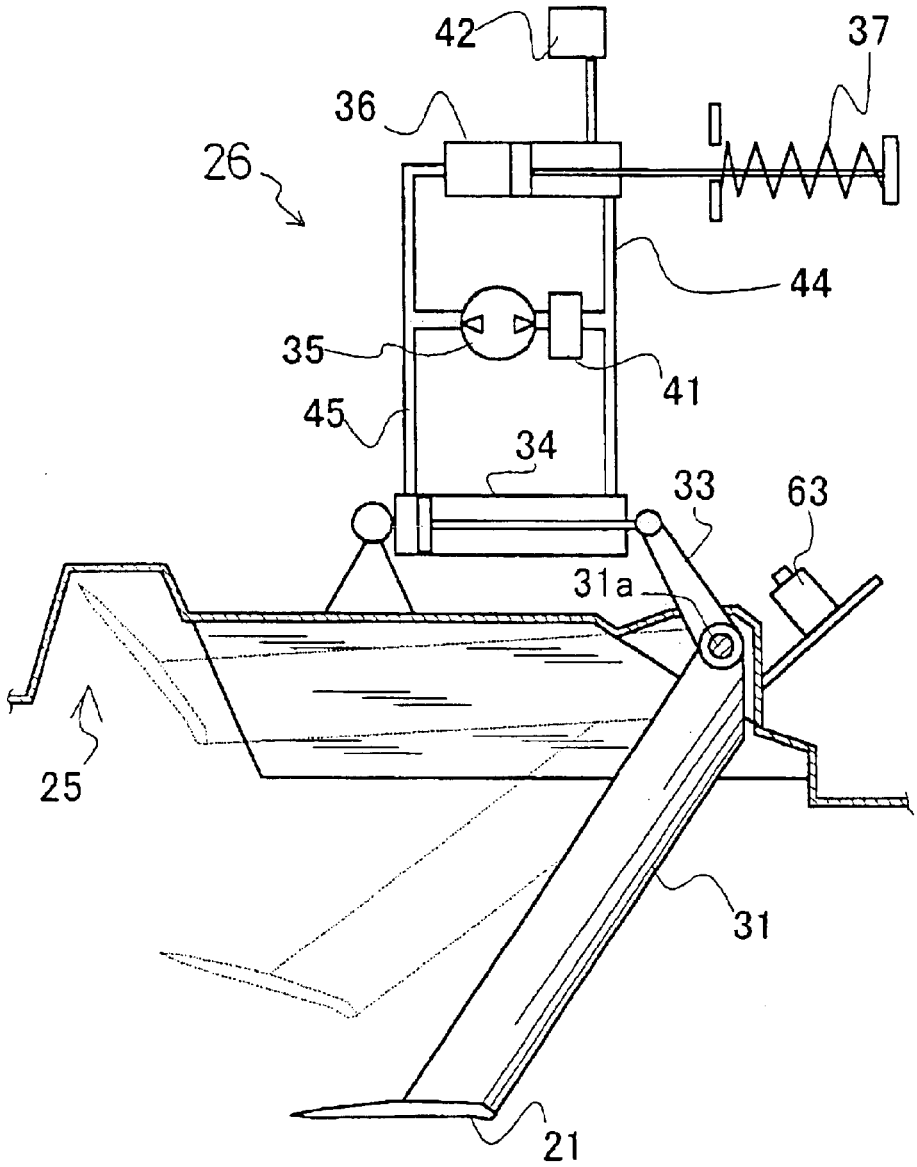
FIG. 10 is a hydraulic oil circuit diagram and a schematic sectional side view of the mechanism for supporting the hydrofoil, which constitute a mechanism for adjusting the hydrofoil-dynamic-lift.

Control cylinder 34 is fed with hydraulic oil by a hydraulic pump 35. Furthermore, it is hydraulically controlled, i.e., extension degree of its piston rod is controlled by operation of an accumulator cylinder 36 so as to control the rotational position of hydrofoil-strut 31, thereby controlling dynamic lift F of hydrofoil 21. Hydrofoil controlling mechanism 26 serving as a hydraulic-fluid system of control cylinder 34 and accumulator cylinder 36 will be described in accordance with FIGS. 10 and 11.

Control cylinder 34 and accumulator cylinder 36 are fluidly connected with each other through a pair of oil passages 44 and 45. That is, the fluid connection of the rod-side room of control cylinder 34 and the rod-side room of accumulator cylinder 36 is made by oil passage 44, and the fluid connection of the anti-rod-side room of control cylinder 34 and the anti-rod-side room of accumulator cylinder 36 is made by oil passage 45.

Hydraulic pump 35 is provided with a pair of inhalation and ejection ports, which are opened for free passage to respective oil passages 44 and 45. A stop valve 41, which is an electromotive closing-motion valve, is interposed between the hydraulic pump and oil passage 44.

When hydrofoil-strut 31 is rotated forward in the time of navigation start etc., the port connected to oil passage 44 serves as the ejection port, and the port connected to oil passage 45 serves as the inhalation port. Therefore, hydraulic oil is made to flow from oil passage 45 to oil passage 44 through hydraulic pump 35 so as to flow into the rod-side room of control cylinder 34, thereby contracting the piston rod. When hydrofoil-strut 31 reaches the limitation of forward rotation, the piston rod of control cylinder 34 has reached the limit of its contraction.

On the contrary, in order to rotate hydrofoil-strut 31 backward when the hydrofoil is going to be stored or so on, hydraulic oil is made to flow from oil passage 44 to oil passage 45 through hydraulic pump 35, thereby elongating the piston rod of control cylinder 34. In addition, a limit switch 63 is arranged ahead of arm 33 in the hull. Ann 33 rotated forward by elongating the piston rod of control cylinder 34 comes to abut against limit switch 63 and turn on or off it when hydrofoil 21 and hydrofoil-strut 31 reaches their fixed storage position. According to this, stop valve 41 is closed and hydraulic pump 35 (in detail, a later-discussed electric motor 35*a*) is shut down, thereby stopping further extension of the piston rod of control cylinder 34.

As shown in FIG. 5, accumulator cylinder 36 is provided with a spring 37, which resists contraction of the piston rod thereof back sliding of the piston thereof). Moreover, a pressure sensor 42 is connected to a rod-side room of accumulator cylinder 36 so as to detect oil pressure in the rod-side room thereof (i.e., oil pressure in oil passage 44 and the rod-side room of control cylinder 34 communicating with it). The relation of piston variation of accumulator cylinder 36 to the oil pressure in the rod-side room thereof is decided by the rate of spring 37. The more hydraulic oil is charged into the rod-side room of accumulator cylinder 36 against the biasing force of spring 37 so as to slide the piston rearward, the larger the oil pressure in the rod-side room thereof becomes. Therefore, if hydraulic pump 35 makes the hydraulic oil flow into oil passage 44 further from the state where the piston rod of control cylinder 34 reaches the contraction limit thereof, the hydraulic oil comes to flow into the rod-side room of accumulator cylinder 36, thereby increasing the oil pressure in the rod-side rooms of both cylinders 34 and 36 and in oil passage 44. Then, if certain oil pressure is detected by pressure sensor 42 and stop valve 41 is closed, the hydraulic oil of this oil pressure comes to be sealed within oil passage 44 and the rod-side rooms of both cylinders 34 and 36.

This oil pressure acts so as to resist the elongation of the rod of control cylinder 34, namely, to resist the rearward rotation of hydrofoil-strut 31. On the other hand, the water pressure applied onto hydrofoil 21 from the front during navigation functions as the force for rotating hydrofoil-strut 31 rearward as well as it functions as dynamic lift F of hydrofoil 21. Therefore, the higher the certain oil pressure to be detected pressure sensor 42 is made, the better hydrofoil 21 resists the water pressure from the front so as to hold hydrofoil-strut 31 to its downward projecting posture for navigation, thereby generating larger dynamic lift F. In other words, a threshold value of dynamic lift F can be established according to setting of this oil pressure, and dynamic lift F can be held near the established threshold value by actuation of accumulator cylinder 36.

In accordance with FIGS. 11(*a*)–(*d*), description will be given of phases of the hydraulic oil control system for control cylinder 34 during the process of folding in-and-out hydrofoil 21 and during the process of conserving the dynamic lift in navigation.

Figure 11:
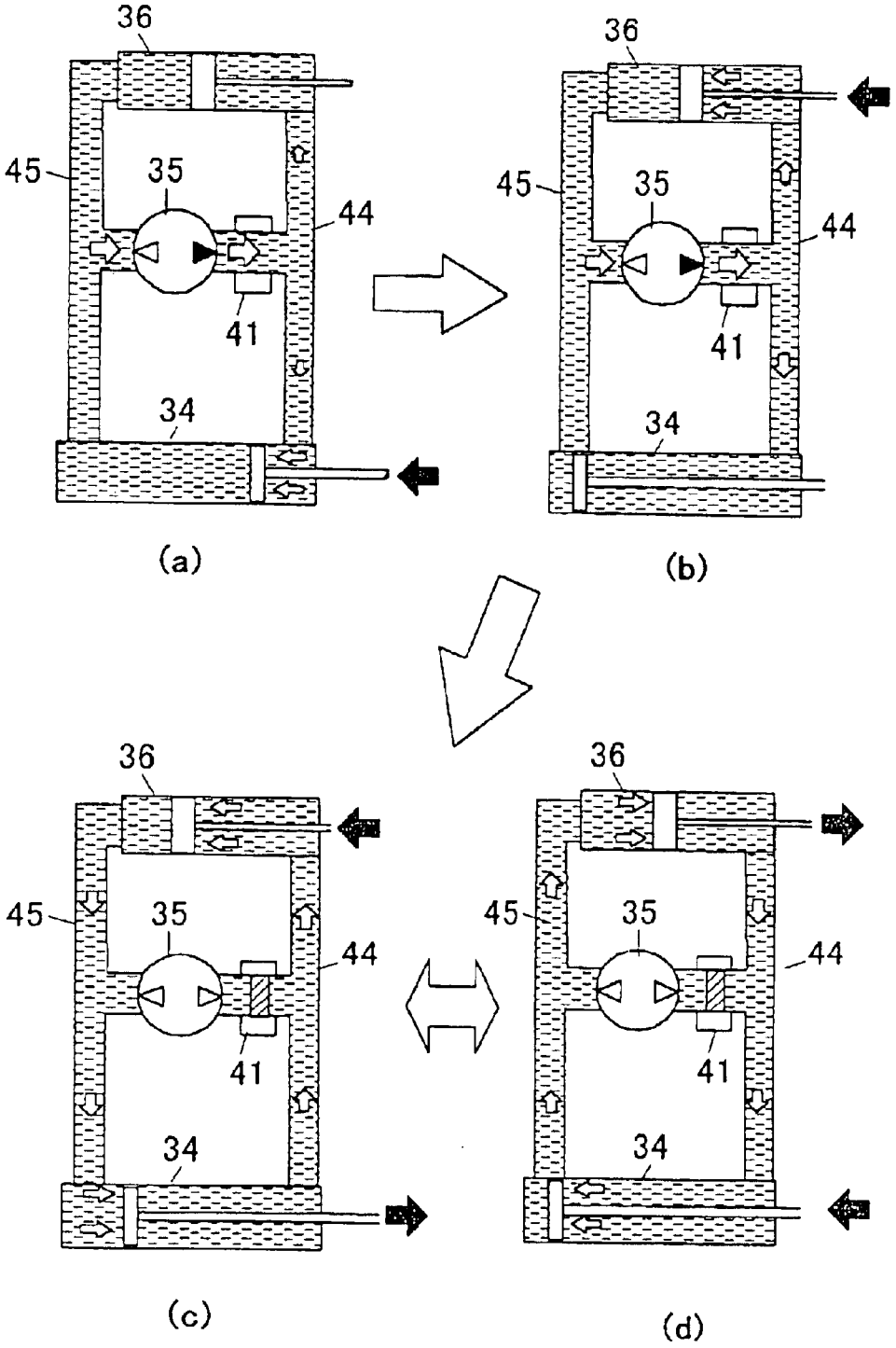
FIG. 11 illustrates hydraulic oil circuit diagrams for rotational actuation of the hydrofoil-strut and for adjusting the hydrofoil-dynamic-lift, wherein (a) is the view during storage of the hydrofoil when a hydraulic pump starts actuating and a stop valve is opened so as to set the hydrofoil into the navigation position, (b) is the view when oil pressure in an accumulator cylinder is further raised so as to acquire a fixed set value of hydrofoil-dynamic-lift after the hydrofoil is set to the navigation position, (c) and (d) are the views when a control for maintaining the hydrofoil-dynamic-lift is preformed during navigation, (c) is when the hydrofoil-strut is rotated backward so as to restrict the hydrofoil-dynamic-lift, and (d) is when the hydrofoil is returned to the navigation position.

When hydrofoil 21 is stored, as shown in FIG. 11(*a*), the piston remains at the position from the time when limit switch 63 is touched and turned by arm 33, so that the piston rod is elongated. Hydraulic pump 35 is stopped and stop valve 41 is closed. When hydrofoil 21 is going to be put into the navigating state, stop valve 41 is opened and hydraulic pump 35 is actuated so as to feed hydraulic oil from oil passage 45 to oil passage 44. At this time, hydraulic oil flows into the rod-side room of control cylinder 34 while the piston of accumulator cylinder 36 remains because of the biasing force of spring 37. Therefore, the piston of control cylinder 34 slides rearward so as to rotate hydrofoil 21 forward and put it into the navigating state. Finally, as shown in (b), control cylinder 34 reaches the maximum contraction location. Furthermore, the oil ejected from hydraulic pump 35 is made to flow into the rod-side room of accumulator cylinder 36 against the biasing force of spring 37, thereby giving a certain holding pressure (i.e., a backward biasing force) to the piston of control cylinder 34 so as to ensure the force for holding hydrofoil-strut 31 and hydrofoil 21 in the navigating state. Thus, the threshold value of dynamic lift F is established. In the phase where pressure sensor 42 detects oil pressure corresponding to this dynamic-lift setting, a stop valve 41 is closed and the actuation of hydraulic pump 35 is stopped. Incidentally, this activity is done while the boat berths.

If hydrofoil boat 1 is made to navigate with hydrofoil 21 set in this state, water pressure is applied from the front onto hydrofoil 21 so as to generate dynamic lift F corresponding to the navigating speed. On the other hand, the water pressure applied from the front onto hydrofoil 21 serves as the force for rearward rotation of hydrofoil-strut 31, i.e., the force for elongating the piston rod of control cylinder 34, which is applied onto the piston from the rear. While the force for elongating the piston rod exceeds the oil pressure in oil passage 44 that is applied from the front onto the piston of control cylinder 34 set in the above way, the piston of control cylinder 34 slides forward, as shown in FIG. 11(*c*). Simultaneously, the piston of accumulator 36 slides rearward so as to reach a position where the biasing force of spring 37 balances with the oil pressure in the rod-side room plus the extension force of the piston rod of control cylinder 34, thereby allowing the piston of control cylinder 34 to slide forward. Whereby, hydrofoil-strut 31 is rotated rearward so as to reduce or deaden dynamic lift F, thereby preventing dynamic lift F from exceeding the set value.

When the water pressure applied on hydrofoil 21 becomes weaker, the piston of accumulator cylinder 36 slides ahead immediately according to the biasing force of spring 37, thereby pushing the hydraulic oil in oil passage 44 and making it flow into the rod-side room of control cylinder 34, as shown in FIG. 11(*d*). Accordingly, the piston of control cylinder 34 slides rearward and rotates hydrofoil-strut 31 ahead so as to move hydrofoil 21 forwardly downward, thereby increasing reduced dynamic lift F so as to restore it immediately.

While navigation at a constant speed for making dynamic lift F close to the set value, the states of FIGS. (c) and (d) are repeated so as to hold dynamic lift F substantially constant, thereby keeping the stability in navigation. Corresponding to the variation of water pressure applied on hydrofoil 21 in this way, accumulator cylinder 36 moves the piston of control cylinder 34, thereby rotating hydrofoil-strut 31 so as to hold dynamic lift F constant.

In order to store hydrofoil 21 from the state of (b), stop valve 41 is opened and hydraulic pump 35 is actuated so as to feed hydraulic oil from oil passage 44 to oil passage 45. Therefore, first, the oil pressure which has made the piston of accumulator cylinder 36 slide rearward against the biasing force of spring 37 is released from the rod-side room of accumulator cylinder 36, thereby returning the piston to the original place. Then, hydraulic oil flows into the anti-rod-side room of control cylinder 34 so as to elongate the piston rod of control cylinder 34. Finally, the elongated piston rod reaches the position shown in (a) where arm 33 contacts limit switch 63, and at this time, stop valve 41 is closed and the actuation of hydraulic pump 35 is stopped.

Description will now be given of control systems for controlling above-mentioned hydraulic-power type hydrofoil-control mechanism 26 and a tilt angle of a propulsor, in accordance with FIGS. 12 to 15.

Figure 12:
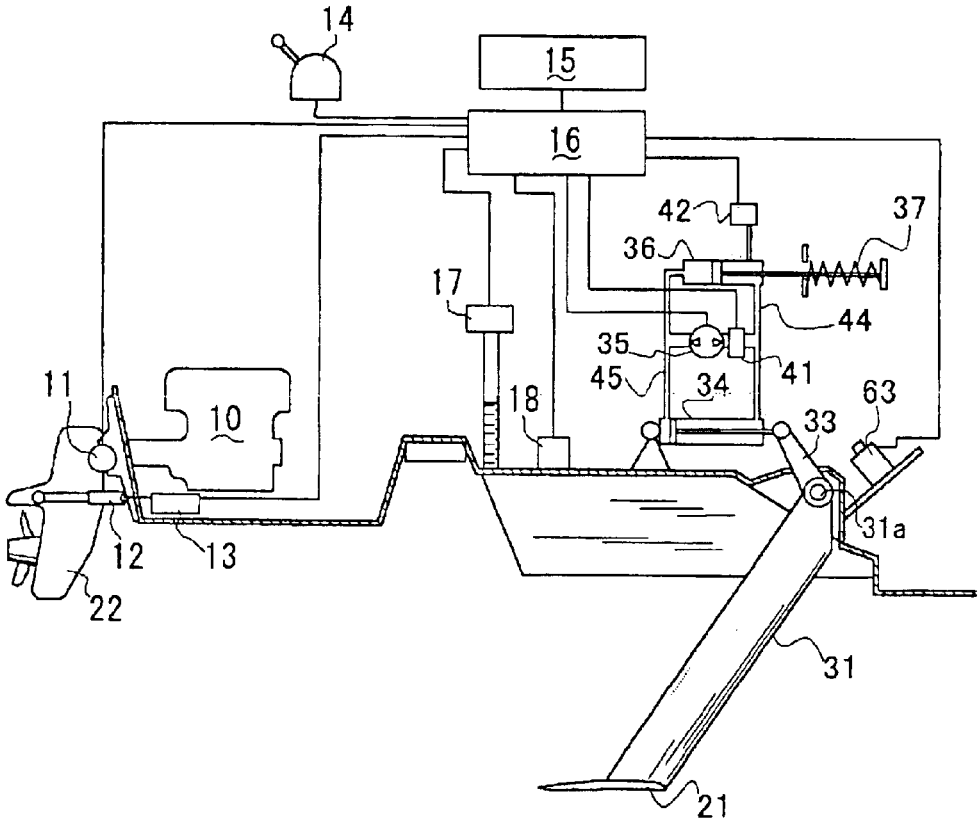
FIG. 12 is a block diagram of the mechanism for adjusting the hydrofoil-dynamic-lift and a mechanism for setting the tilt angle of propulsor, including a schematic configuration view in part.

As shown in FIG. 12, an engine 10 and a propulsor 22 joined to engine 10 are attached to the stern of hydrofoil boat 1. A propeller of propulsor 22 is rotationally driven by power of engine 10. Propulsor 22 is vertically rotated by actuation of a hydraulic tilt cylinder 12. A hydraulic power package 13 for tilt of propulsor 22 is provided in the hull so as to control the actuation of tilt cylinder 12.

Figure 13:
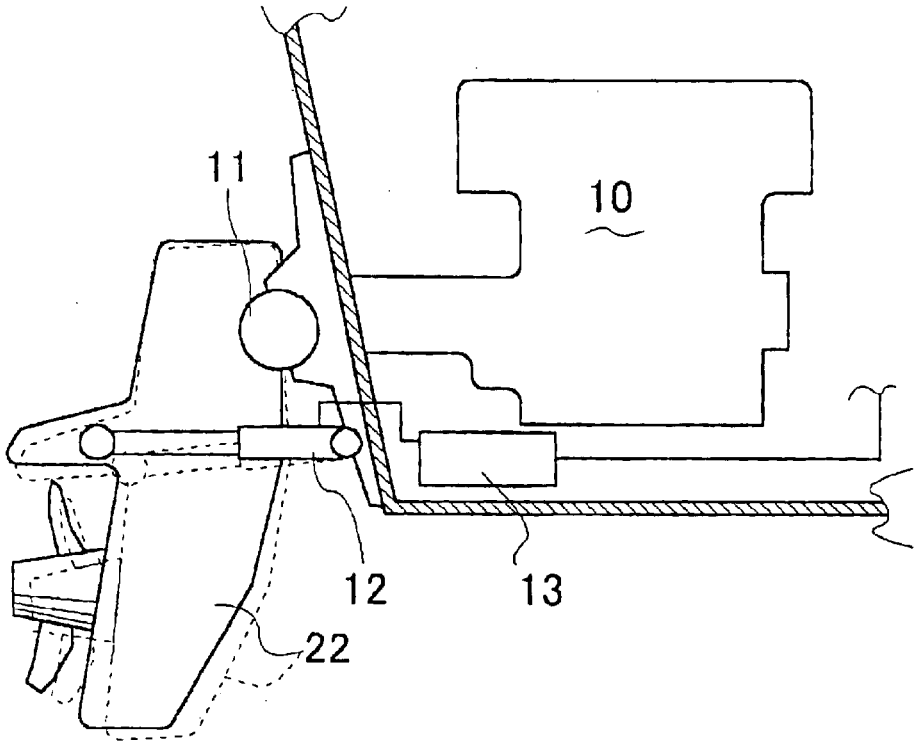
FIG. 13 is a diagram of the mechanism for adjusting the tilt angle of propulsor.
Figure 14:
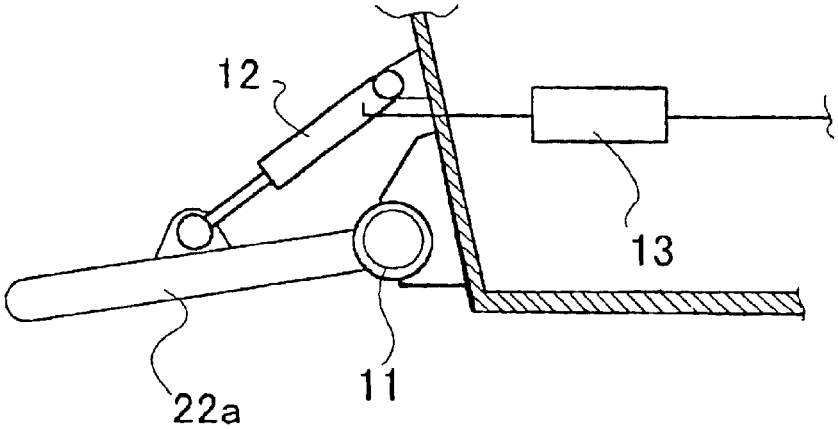
FIG. 14 is a schematic side view of a mechanism for adjusting a tilt angle of flap when a flap is attached to a stern without tilting the propulsor.
Figure 15:
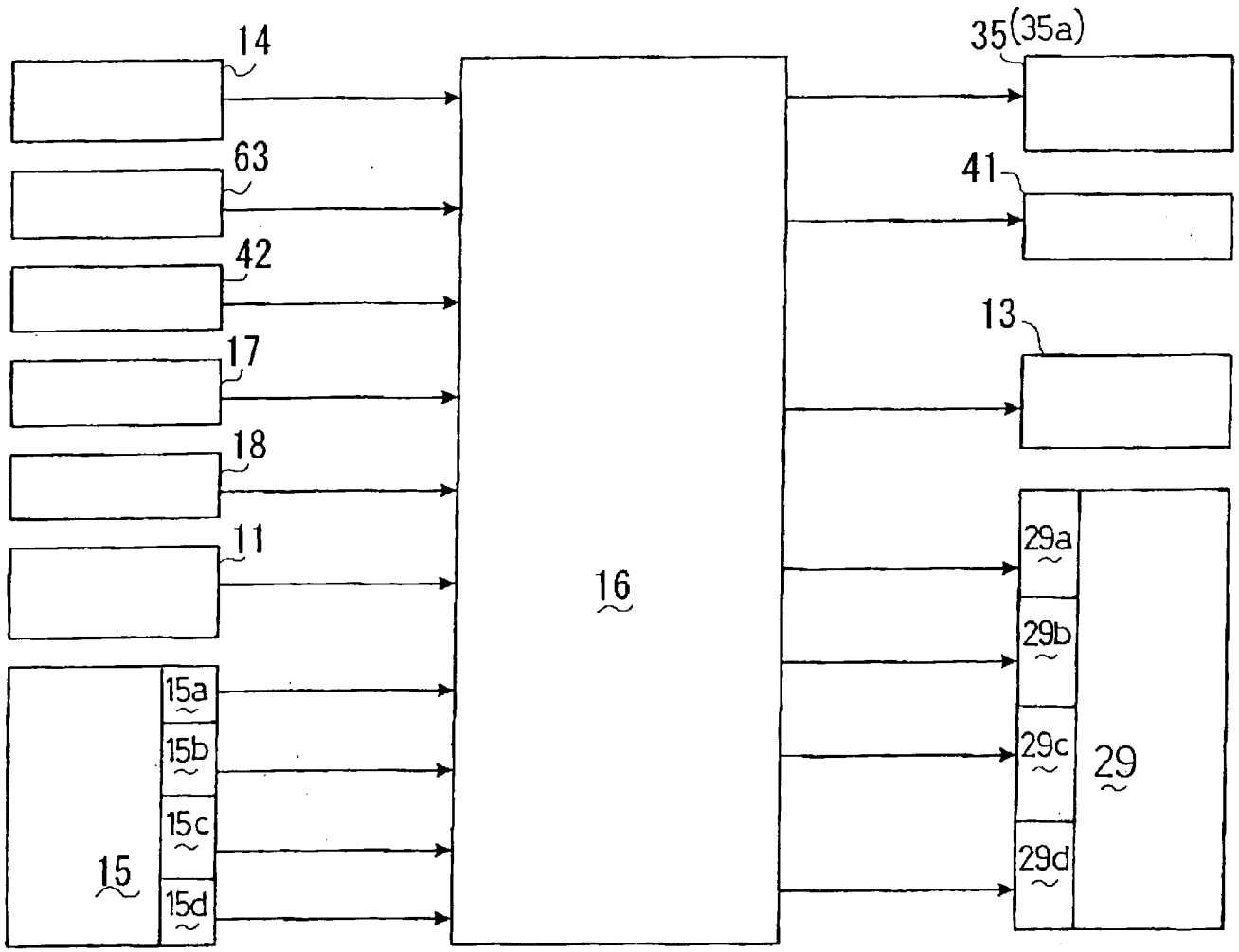
FIG. 15 is a systematic block diagram of a configuration for controlling the tilt angles of hydrofoil and propulsor with a controller.

Propulsor 22 shown in FIG. 12 is vertically rotatable, and as shown in FIG. 13, it is vertically rotated by tilt cylinder 12 so as to adjust the attack angle of the hull. Alternatively, propulsor 22 may be fixed to the stem by attaching a flap 22*a* to the stem, as shown in FIG. 14, so as to make tilt cylinder 12 control the vertical tilt angle of flap 22*a*. This case also effects similarly with the case of controlling the vertical tilt angle of propulsor 22. Incidentally, it is also permissible that both propulsor 22 and flap 22*a* can be controlled in their tilts.

As shown in FIGS. 12 to 15, as detection means besides above-mentioned pressure sensor 42 and limit switch 63 of hydrofoil-control mechanism 26, there are provided an inclination sensor 18 which detects the inclination of the hull, a draft gauge 17 which detects draft, a tilt angle sensor 11 which is a potentiometer for detecting the vertical tilt angle of propulsor 22 (in the embodiment of FIG. 14, the vertical tilt angle of flap 22*a*), and a clutch neutral switch 14 which detects the neutrality of a clutch. Furthermore, a console panel 15 is provided with various demanding switches including a main switch 15*a*, a tilt down switch 15*b*, a tilt rise switch 15*c*, and a reset switch 15*d*. These input means are connected to an input interface of a controller 16.

Incidentally, inclination sensor 18 and draft gauge 17 are arranged in the bottom. Especially, inclination sensor 18 is arranged in the hull above the middle bottom section just ahead of second step 4, and behind hydrofoil 21 in the navigating position.

To an output interface of controller 16 are connected hydraulic pump 35 and stopper valve 41 in hydrofoil-control mechanism 26, which are electromotive, and a hydraulic power package 13 for propulsor-attitude control, and further, an indicator 29. Output signals to such output means are transmitted by controller 16 based on the input values of the various input means. Hydraulic pump 35 is controlled in its actuation and reversing, and stop valve 41 is controlled in its opening-and-closing, thereby controlling the hydrofoil-dynamic lift. In hydraulic power package 13 for propulsor-attitude control, actuation and reversing of a hydraulic motor for feeding propulsor-tilt cylinder 12 is controlled, thereby controlling the tilt angle of propulsor 22(or flap 22*a*).

Indicator 29 is arranged near console panel 15 so as to recognize the control situation of controller 16. An emergency lamp 29*a*, a lamp 29*b* for indicating navigation-allowance, and a lamp 29*c* for indicating allowance of dynamic-lift-setting and tilt-rise are provided on indicator 29. These lamps are lighted on or off for indicating setting on-and-off of modes, safety, or warning. Moreover, tilt-angle meter 29*d*, which shows the value detected by tilt-angle sensor 11, is provided.

Description will now be given of manner for setting the hydrofoil-dynamic-lift, and manner for setting the tilt angle of propulsor (flap), in accordance with FIGS. 16 and 17, etc.

Figure 16:
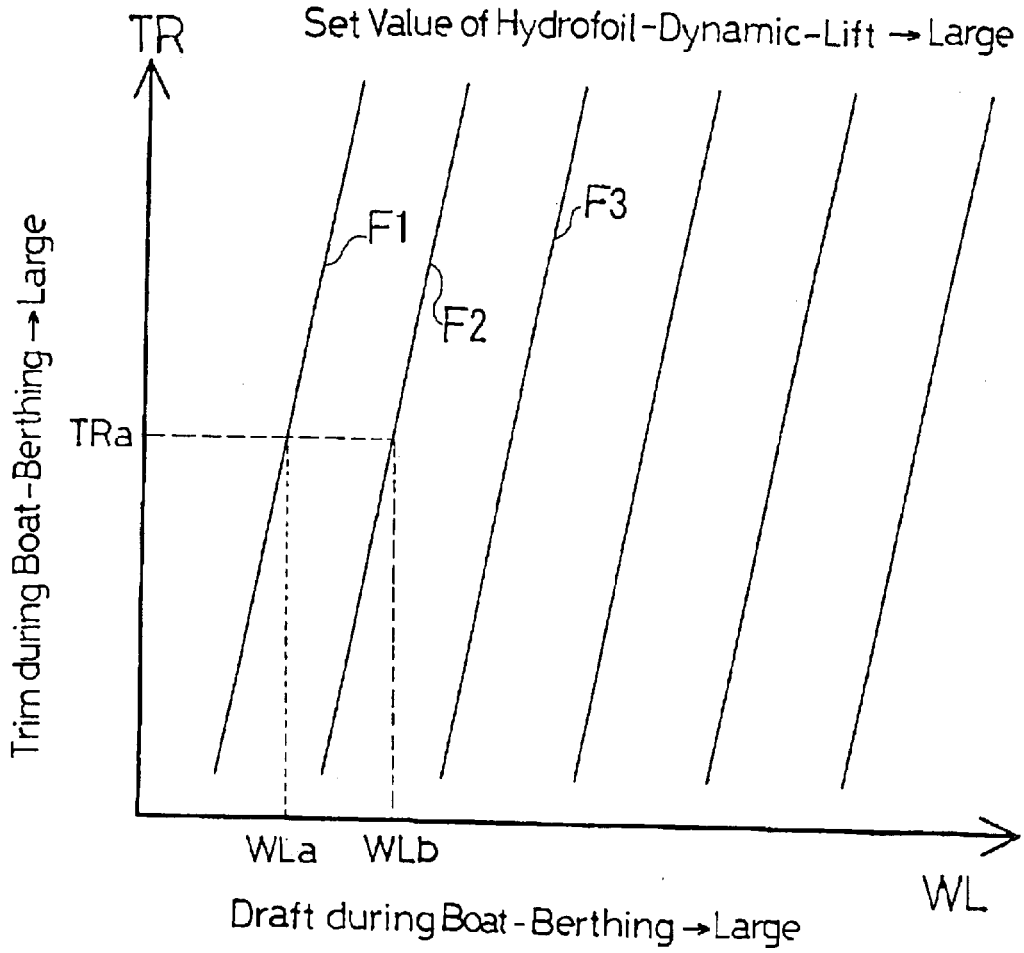
FIG. 16 is a graph serving as a map for setting the hydrofoil-dynamic-lift corresponding to the trim angle and draft during berthing.
Figure 17:
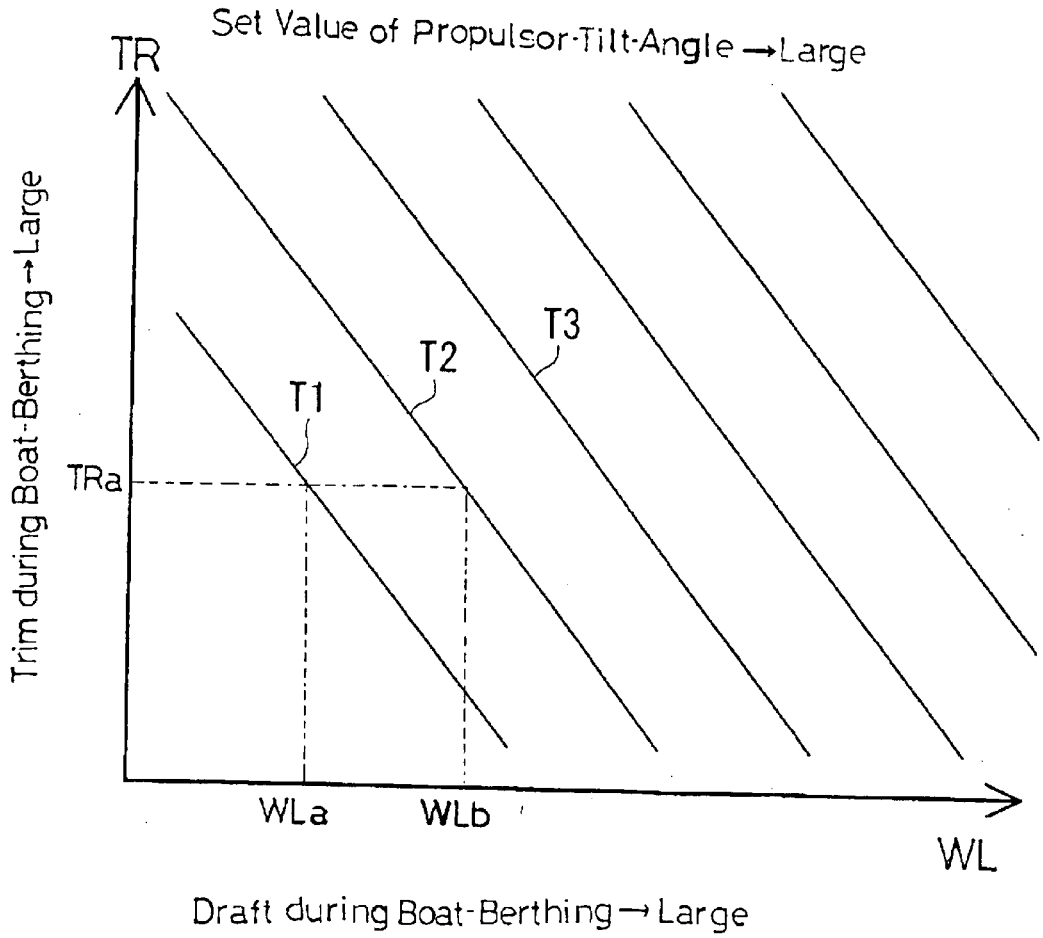
FIG. 17 is a graph serving as a map for setting the tilt angle of propulsor corresponding to the trim angle and draft during berthing.

In order to set hydrofoil-dynamic-lift F corresponding to a trim angle TR and draft WL when boat-berthing, a map for decision of set value of hydrofoil-dynamic-lift as shown in FIG. 16 is made. Dynamic lift F is made so small as trim angle TR when boat-berthing becomes large, thereby keeping the trim angle in navigation optimal, whereby the effect of drag-reduction in navigation is enhanced and the hydroplaning capacity is assured. Moreover, draft WL is so much as the boat-mass becomes large mainly because the weight of loads increases. Therefore, in order to assure a constant rate of hydrofoil-dynamic-lift loaded on the hydrofoil, dynamic lift F is set so great as draft WL is large. According to these essentialities, as shown in FIG. 16, a map for choosing a set value of dynamic lift among F1, F2, F3, F4, etc. which are larger one after another is made and memorized by controller 16.

Trim angle TR during boat-berthing is detected by inclination sensor 18 shown in FIG. 12. Draft WL during boat-berthing is detected by draft gauge 17 shown in FIG. 12. Controller 16 applies these detection values into the above-mentioned map of FIG. 16, so as to choose one optimal set value of hydrofoil-dynamic-lift among F1, F2, etc. For example, if trim angle TR during boat-berthing is TRa and draft WL during boat-berthing is WLa, hydrofoil-dynamic-lift F1 is selected as the set value. If trim angle TR during boat-berthing is the same and draft WL during boat-berthing is WLb larger than WLa, larger hydrofoil-dynamic-lift F2 than F1 is selected. The piston of accumulator cylinder 35 is so located as to acquire a value detected by pressure sensor 42 which serves as the oil pressure in oil passage 44 and the rod-side rooms of control cylinder 34 and accumulator cylinder 36 corresponding to the hydrofoil-dynamic-lift picked up from the map in this way.

Moreover, tilt angle T of propulsor 22 or flap 22*a* in the embodiment shown in FIG. 14 becomes so large (positive angle) as the angle between the propeller shaft and the water surface is large. In order to set this tilt angle T corresponding to trim angle TR and draft WL during boat-berthing, a tilt-angle-setting map is made and memorized by controller 16. The set value of tilt angle T is made so large as trim angle TR during boat-berthing becomes large, and as draft WL becomes large. The map of FIG. 17 is made to enable tilt angles T1, T2, T3, T4, etc. which are larger one after another, to be set corresponding to trim angle TR and draft WL.

Referring to the procedure for setting the tilt angle, during boat-berthing, inclination sensor 18 detects trim angle TR and draft gauge 17 detects draft WL. These detection values are input unto controller 16 so that one of tilt angles T1, T2, etc. is chosen based on the map of FIG. 17. For example, if trim angle TR during boat-berthing is TRa and draft WL during boat-berthing is WLa, tilt angle Ti is selected as the set value. If trim angle TR during boat-berthing is the same and draft WL during boat-berthing is WLb larger than WLa larger tilt angle F2 than F1 is selected. A control signal is transmitted to hydraulic cylinder 13 for actuating tilt cylinder 12 so as to make tilt angle sensor 11 detect the set value of tilt angle chosen from the map. In this way, the maximum propulsion can be assured by making the tilt angle of propulsor 22 or flap 22*a* correspond to the trim angle and draft of the hull.

Figure 18:
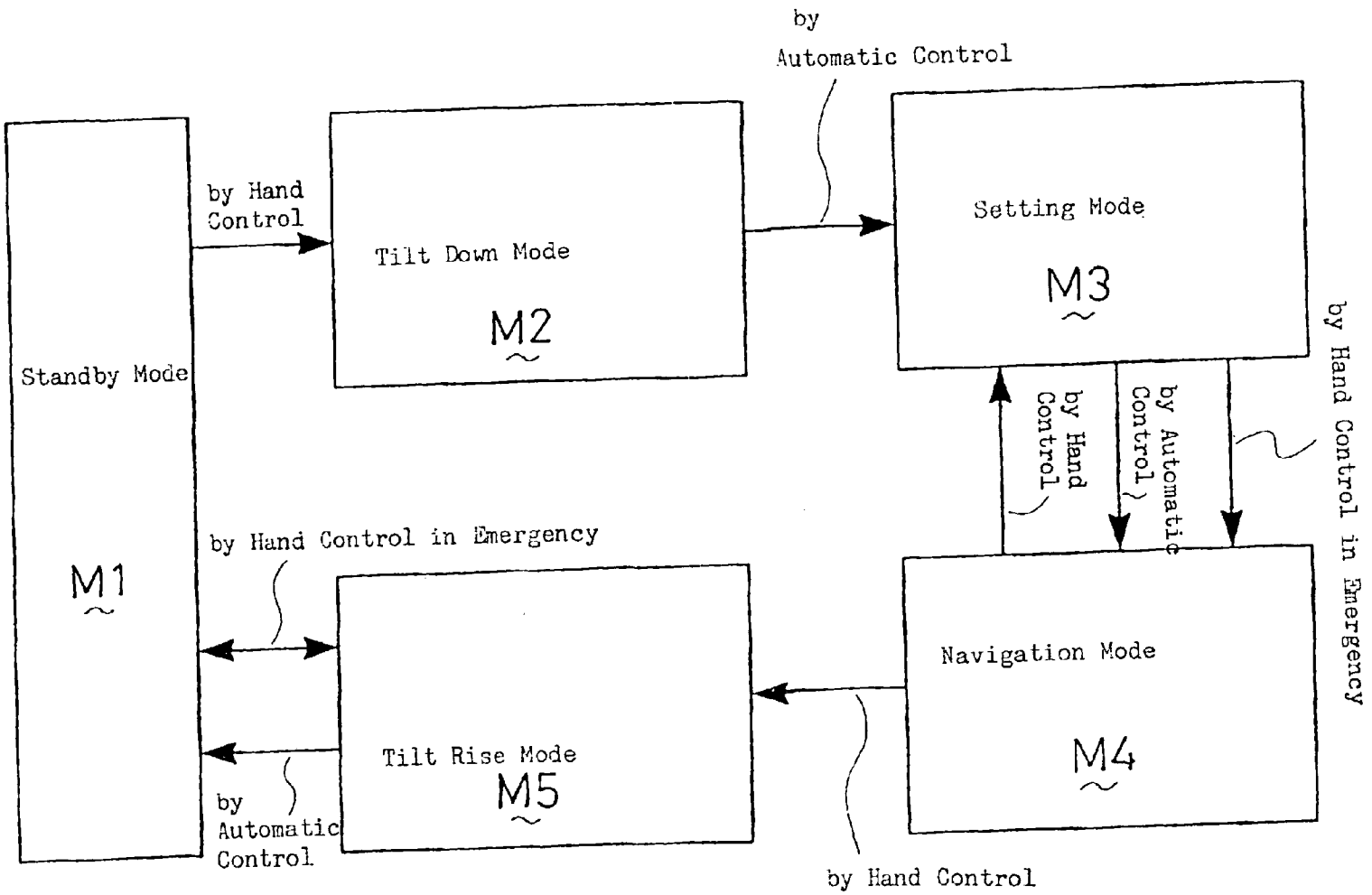
FIG. 18 is a chart showing transition in the mode of the controller.

Description will be given of transition of mode concerning the control in controller 16 of hydrofoil boat 1, in accordance with FIG. 18.

Hydrofoil boat 1 is established as a standby mode M1 at the time of starting, wherein hydrofoil 21 and hydrofoil-strut 31 are stored. For navigation using hydrofoil 21, tilt down switch 15*c* is turned on with hand control so as to establish a tilt down mode M2. In tilt down mode M2, by contracting the piston rod of control cylinder 34, hydrofoil-strut 31 is rotated below and hydrofoil 21 is set to its predetermined navigating position.

After hydrofoil 21 is set in its navigating position by establishing tilt down mode M2, the mode automatically transits to a setting mode M3. In setting mode M3, as mentioned above, the detection by draft gauge 17 and inclination sensor 18 and the maps shown in FIGS. 16 and 17 are used so as to set hydrofoil-dynamic-lift F which corresponds to the condition of hydrofoil boat 1 and set tilt angle T of propulsor 22(flap 22*a*). After these settings are over, the mode automatically transits to a navigation mode M4. In this mode, desired speed is set so that the propeller is driven, thereby enabling navigation. In addition, at the time of abnormalities, compulsory transition from setting mode M3 to navigation mode M4 can be made by hand control so as to stop the control for setting hydrofoil-dynamic-lift F and tilt angle T. In an abnormal state, emergency lamp 29*a* is lighted on.

In navigation mode M4, hydrofoil boat 1 can hydroplane using hydrofoil 21. Transition from navigation mode M4 to setting mode M3 or tilt rise mode M5 can be made by hand control. Tilt rise mode M5 is a mode for storing hydrofoil 21, and is established by turning on tilt rise switch 15*c*. In tilt rise mode M5, the piston rod of control cylinder 34 is extended so as to store hydrofoil 21 and hydrofoil-strut 31, and then, the mode transits to standby mode M1. Moreover, in an emergency state, transition from tilt rise mode MS to standby mode M1 can be made by hand control so as to stop hydrofoil-strut 31 on the way of its backward rotation. Also, transition from standby mode M1 to tilt rise mode M5 can be made by hand control so as to resume the backward rotation of hydrofoil-strut 31.

Figure 19:
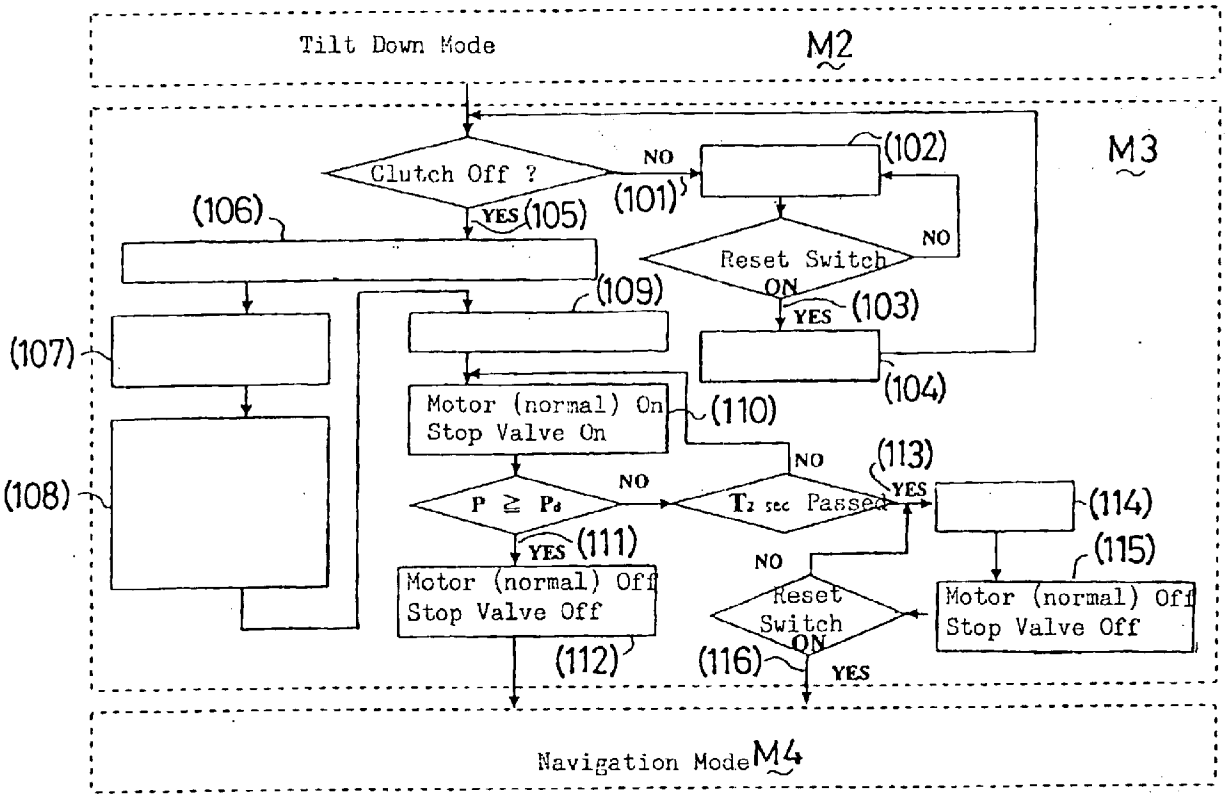
FIG. 19 is a control flowchart showing a procedure especially in a setting mode on the way of transition from a tilt down mode to a navigation mode.

In accordance with FIG. 19, description will now be given of a procedure especially in setting mode M3 while transition from tilt down mode M2 to navigation mode M4 through setting mode M3 is made.

First, when the transition to setting mode M3 from tilt down mode M2 is made, it is asked whether the clutch is neutrality. When clutch neutral switch 14 is turned on and it is checked that a clutch is neutrality (105), draft, a trim, and a propulsor-tilt angle are detected by draft gauge 17, inclination sensor 18, and tilt-angle sensor 11, respectively (106). When the clutch is not neutral (101), emergency lamp 29*a* is lighted on (102). Accordingly, limit switch 15*d* is turned on (103) so as to light off emergency lamp 29*a* (104), and it is checked again whether the clutch is neutral.

If the clutch is neutral and the draft, the trim, and the propulsor-tilt angle are detected, calculation of the set value of propulsor-tilt angle T is performed (107), and hydraulic power package 13 actuates so as to adjust the tilt angle of propulsor 22 to the set value (108).

Next, a set value Pd of oil pressure, within oil passage 44 and both the rod-side rooms of hydraulic cylinders 34 and 36 in above-mentioned hydrofoil-dynamic-lift control mechanism 26, is computed for establishing hydrofoil-dynamic-lift (109). Then, electric motor 35*a* for actuation of hydraulic pump 35 is driven in a normal direction and stop valve 41 is opened (110), thereby making hydraulic oil from oil passage 45 to oil passage 44. In this way, if hydraulic oil pressure P flowing into control cylinder 34 becomes set pressure Pd or more (111), motor 35*a* for actuating hydraulic pump 35 is shut down and stop valve 41 is closed (112). The mode transits to navigation mode M4.

In addition, during the setting of hydrofoil-dynamic-lift when hydraulic oil is made to flow from oil passage 45 to oil passage 44, if a fixed time T2 has passed and hydraulic oil pressure P is under set value Pd (113), emergency lamp 29*a* is lighted on (114), motor 35*a* for actuating hydraulic pump 35 is shut down and stop valve 41 is closed (115). If reset-switch 15*a* is turned on (116), the mode transits to navigation mode M4 in this phase.

Figure 20:
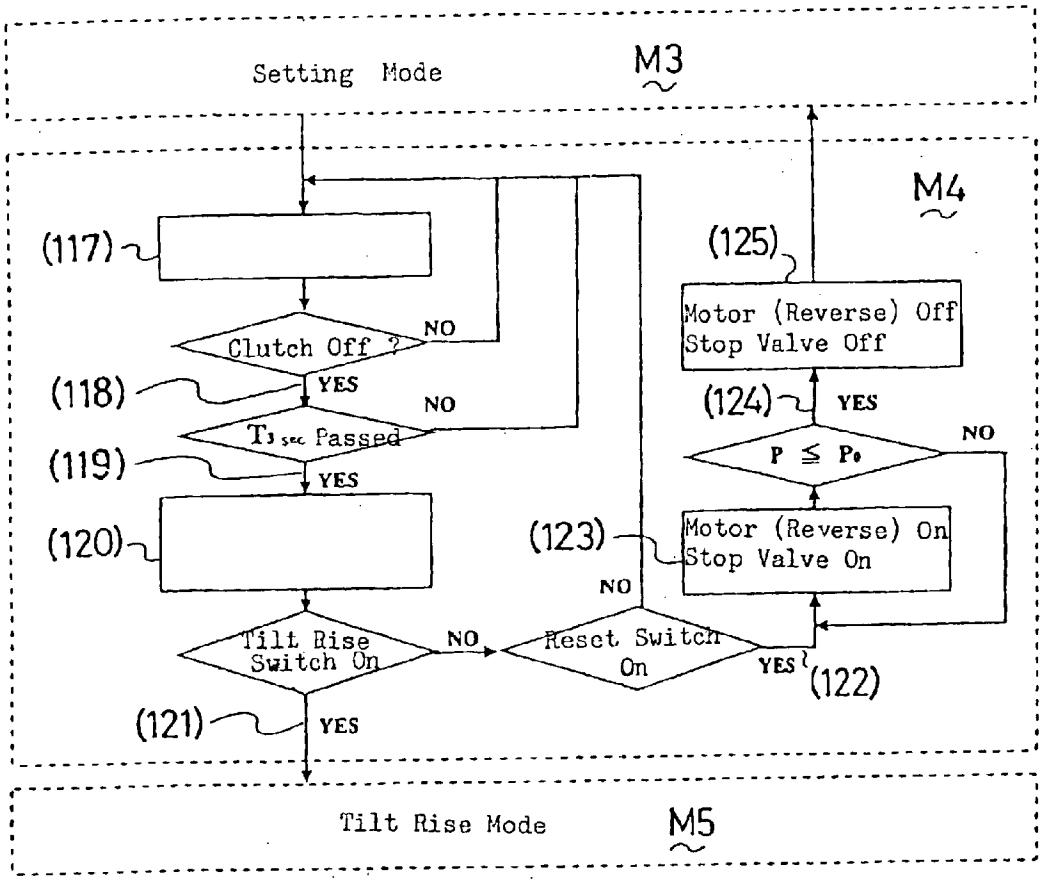
FIG. 20 is a control flowchart showing a procedure especially in the navigation mode on the way of transition from the setting mode to the tilt down mode.

Continuously, description will be given of a procedure especially in navigation mode M4 while transition from setting mode M3 to tilt rise mode MS through navigation mode M4 is made, in accordance with FIG. 20.

First, when the transition to navigation mode M4 from setting mode M3 is made, navigation-allowance lamp 29*b* is lighted on (117). At this time, it becomes possible to engage the clutch and to make the boat navigate at requested speed. When it is requested to stop navigation and store hydrofoil 21, or to reset the hydrofoil-dynamic-lift anew, the clutch is put into neutral. After clutch neutral switch 14 turns on (118) and a fixed time T3 passes (119), lamp 29*c* for allowance of dynamic-lift-setting and tilt-rise is lighted on (120). If tilt rise switch 15*c* of console panel 15 is turned on during the lighting of lamp (121), the mode transits to tilt rise mode M5. Although not drawn in FIG. 17, in tilt rise mode MS, electric motor 35 for controlling the hydraulic pump is driven conversely and stop valve 41 is opened so that hydraulic oil is made to flow from oil passage 44 to oil passage 45 through hydraulic pump 35 so as to flow into the anti-rod-side room of control cylinder 34, thereby expanding the piston rod.

Moreover, if the dynamic lift is going to be reset anew while lamp 29*c* for allowance of dynamic-lift-setting and tilt-rise is lighted on, reset-switch 15*d* is turned on (122). In this way, electric motor 35*a* for controlling the hydraulic pump is driven conversely and stop valve 41 is opened (123), thereby making hydraulic oil flow from oil passage 44 to oil passage 45 through hydraulic pump 35. However, unlike the tilt-rising, the flow of hydraulic oil is not made so much as to expand the piston rod of control cylinder 34. When it is recognized that pressure P detected by pressure sensor 42 has decreased to oil pressure $P_0$ corresponding to the fixed position of the piston of accumulator cylinder 36 (124), motor 35*a* and stop Valve 41 are turned off(125) so as to make the mode transit to setting mode M3.

Possibility of Industrial Applicability

The hydrofoil according to the present invention is provided with a double-stepped bottom so as to restrict the movement of centroid and the fluctuation of trim while the hydrofoil-dynamic-lift and the weight of loads vary, thereby enabling the hydrofoil-dynamic-lift to be set high. Thus, it is applicable to a boat having a whole-submerged hydrofoil such as a fishing boat, a leisure boat, etc.

What is claimed is:

1. A hydrofoil boat, comprising:

one front step and one rear step formed in a portion of the boat including at least a lateral middle bottom of the boat, where a bottom-centroid is established between said front step and said rear step;

a whole-submerged hydrofoil;

a retractable strut supporting said hydrofoil, wherein said strut is arranged between said front step and said rear step; and a storage recess formed rearward from said rear step for storing said hydrofoil when retracted.

2. The hydrofoil boat according to claim 1, wherein dynamic lift of said hydrofoil can be set arbitrarily, and said dynamic lift can be held to a set value thereof during navigation.

3. The hydrofoil boat according to claim 2, wherein said strut can be rotated forward and backward so as to be switched between a storage state and a navigation state, and wherein the navigation state is conserved correspondingly to said set value of dynamic lift of said hydrofoil.

4. The hydrofoil boat according to claim 2, wherein a set value of hydrofoil-dynamic-lift, and a set value of angle of a propulsor or a flap arranged in the rear of said boat can be adjusted based on draft or a trim angle during boat-berthing.

5. The hydrofoil boat according to claim 1, further comprising:

a cylinder connected to said hydrofoil;

a pump connected to said cylinder, wherein said pump inhales and ejects hydraulic oil so as to telescope said cylinder, thereby making said hydrofoil rotate forward and rearward so as to be switched between a storage state and a navigation state; and an accumulator cylinder connected to said cylinder so as to hold a set value of dynamic lift of said hydrofoil while said hydrofoil is put in said navigation state.

6. The hydrofoil boat according to claim 5, wherein oil pressure in an oil room of said cylinder is adjusted so as to enable said dynamic lift of hydrofoil to be set arbitrarily.

7. The hydrofoil boat according to claim 1, wherein when said hydrofoil is retracted in said storage recess, said strut is substantially concealed between said front step and said rear step as viewed from the side of the boat.

8. A hydrofoil boat comprising:

a bottom comprising a front portion, a middle portion, and a rear portion, wherein a front step is formed between the front portion and the middle portion, and a rear step is formed between the middle portion and the rear portion, said front and rear steps extending in a direction perpendicular to a navigating direction and facing a rear end of the boat, where a bottom-centroid is established between said front step and said rearsteps;

a hydrofoil fully submerging during navigation;

a retractable strut supporting the hydrofoil and being disposed in the middle portion to prevent lowering trim moment of the boat during navigation; and a storage recess formed rearward from said rear step for storing said hydrofoil when retracted.

9. The hydrofoil boat according to claim 8, wherein dynamic lift of said hydrofoil is capable of being set arbitrarily, and said dynamic lift is capable of being held to a set value thereof during navigation.

10. The hydrofoil boat according to claim 9, wherein said strut is capable of being rotated forward and backward so as to be switched between a storage state and a navigation state, and wherein the navigation state is conserved correspondingly to said set value of dynamic lift of said hydrofoil.

11. The hydrofoil boat according to claim 9, wherein a set value of hydrofoil-dynamic-lift, and a set value of angle of a propulsor or a flap arranged in the rear of said boat are capable of being adjusted based on draft or a trim angle during boat-berthing.

12. The hydrofoil boat according to claim 8, further comprising:

a cylinder connected to said hydrofoil;

a pump connected to said cylinder, wherein said pump inhales and ejects hydraulic oil so as to telescope said cylinder, thereby making said hydrofoil rotate forward and rearward so as to be switched between a storage state and a navigation state; and an accumulator cylinder connected to said cylinder so as to hold a set value of dynamic lift of said hydrofoil while said hydrofoil is put in said navigation state.

13. The hydrofoil boat according to claim 12, wherein oil pressure in an oil room of said cylinder is adjusted so as to enable said dynamic lift of hydrofoil to be set arbitrarily.

14. The hydrofoil boat according to claim 8, wherein when said hydrofoil is retracted in said storage recess, said strut is substantially concealed between said front step and said rear step as viewed from the side of the boat.

15. A hydrofoil boat, comprising:

one front step and one rear step formed in a portion of the boat including at least a lateral middle bottom of the boat;

a whole-submerged hydrofoil;

a strut supporting said hydrofoil, wherein said strut is arranged between said two steps;

a cylinder connected to said hydrofoil;

a pump connected to said cylinder, wherein said pump inhales and ejects hydraulic oil so as to telescope said cylinder, thereby making said hydrofoil rotate forward and rearward so as to be switched between a storage state and a navigation state; and an accumulator cylinder connected to said cylinder so as to hold a set value of dynamic lift of said hydrofoil while said hydrofoil is put in said navigation state.

16. The hydrofoil boat according to claim 15, wherein oil pressure in an oil room of said cylinder is adjusted so as to enable said dynamic lift of hydrofoil to be set arbitrarily.

17. A hydrofoil boat, comprising:

a bottom comprising a front portion, a middle portion, and a rear portion, wherein said portions each have substantially equal lengths along a longitudinal axis of said bottom;

one front step and one rear step formed in said middle portion and extending laterally along the bottom;

a whole-submerged hydrofoil;

a retractable strut supporting said hydrofoil, wherein said strut is arranged between said front step and said rear step; and a storage recess formed rearward from said rear step for storing said hydrofoil when retracted, wherein when said hydrofoil is retracted in said storage recess, said strut is substantially concealed between said front step and said rear step as viewed from the side of the boat.

18. A hydrofoil boat comprising:

a bottom comprising a front portion, a middle portion, and a rear portion, wherein a front step is formed between the front portion and the middle portion, and a rear step is formed between the middle portion and the rear portion, said front and rear steps extending in a direction perpendicular to a navigating direction and facing a rear end of the boat;

a hydrofoil fully submerging during navigation;

a retractable strut supporting the hydrofoil and being disposed in the middle portion to prevent lowering trim moment of the boat during navigation; and a storage recess formed rearward from said rear step for storing said hydrofoil when retracted, when said hydrofoil is retracted in said storage recess, said strut is substantially concealed between said front step and said rear step as viewed from the side of the boat.

19. A hydrofoil boat, comprising:

a bottom comprising a front portion, a middle portion, and a rear portion, wherein said portions each have substantially equal lengths along a longitudinal axis of said bottom;

one front step and one rear step formed in said middle portion extending laterally along the bottom, wherein a dynamic lift is generated between said front step and said rear step when the boat is navigated;

a whole-submerged hydrofoil;

a retractable strut supporting said hydrofoil, wherein said strut is arranged between said front step and said rear step; and a storage recess formed rearward from said rear step for storing said hydrofoil when retracted.

20. The hydrofoil boat according to claim 19, wherein when said hydrofoil is retracted in said storage recess, said strut is substantially concealed between said front step and said rear step as viewed from the side of the boat.

21. A hydrofoil boat comprising:

a bottom comprising a front portion, a middle portion, and a rear portion, wherein a front step is formed between the front portion and the middle portion, and a rear step is formed between the middle portion and the rear portion, said front and rear steps extending in a direction perpendicular to a navigating direction and facing a rear end of the boat, wherein a dynamic lift is generated between said front step and said rear step when the boat is navigated;

a hydrofoil fully submerging during navigation;

a retractable strut supporting the hydrofoil and being disposed in the middle portion to prevent lowering trim moment of the boat during navigation; and a storage recess formed rearward from said rear step for storing said hydrofoil when retracted.

22. The hydrofoil boat according to claim 21, wherein when said hydrofoil is retracted in said storage recess, said strut is substantially concealed between said front step and said rear step as viewed from the side of the boat.

* * * * *

UNITED STATES PATENT AND TRADEMARK OFFICE

CERTIFICATE OF CORRECTION

PATENT NO. : 6,782,839 B1
DATED : August 31, 2004
INVENTOR(S) : Takeaki Nozaki

It is certified that error appears in the above-identified patent and that said Letters Patent is hereby corrected as shown below:

Column 2,
Line 15, delete "stem" and insert -- stern --, therefor.
Line 51, after "in a" insert -- portion thereof including at least a lateral middle --.
Lines 65-66, after "invention," insert -- the hydrofoil-dynamic-lift can be set arbitrarily, and can be held to the set value during navigation. Furthermore, --.
Lines 66-67, delete "that the position thereof may be changed" and insert -- as to be switched --, therefor.
Line 67, delete "position" and insert -- state --, therefor.

Column 3,
Line 1, delete "position" and insert -- state --, therefor.
Line 8, after "adjust" insert -- set values for navigation about --.
Lines 9-10, delete "corresponding to" and insert -- based on --, therefor.
Line 20, below "capacity" insert the following as new Paragraphs:
-- Furthermore, the hydrofoil is connected to a cylinder. To the cylinder is connected a pump for switching the hydrofoil between the storage state and the navigation by inhaling and ejecting oil so as to telescoping the cylinder, and an accumulator cylinder for conserving the dynamic lift of the hydrofoil when the hydrofoil is put in the navigation state. Therefore, the cylinder is actuated correspondingly to variation of water pressure applied onto the hydrofoil so as to rotate the hydrofoil, thereby holding the dynamic lift constant.

In addition, justment of oil pressure in the cylinder enables the hydrofoil-dynamic-lift to be set arbitrarily. Accordingly, a threshold value of dynamic lift can be set by setting the oil pressure. The dynamic lift can be conserved near the threshold value by operation of the accumulator cylinder. --.

Line 21, delete "DRAWING" and insert -- DRAWINGS --, therefor.

Column 4,
Lines 46 and 64, delete "stem" and insert -- stern --, therefor.
Line 54, delete "fill" and insert -- full --, therefor.

Column 5,
Line 44, delete "Oust" and insert -- just --, therefor.
Line 50, delete "stem" and insert -- stern --, therefor.

Column 6,
Line 40, delete "lit-of-stability" and insert -- limit-of-stability --, therefor.

UNITED STATES PATENT AND TRADEMARK OFFICE

CERTIFICATE OF CORRECTION

PATENT NO. : 6,782,839 B1
DATED : August 31, 2004
INVENTOR(S) : Takeaki Nozaki

It is certified that error appears in the above-identified patent and that said Letters Patent is hereby corrected as shown below:

Column 8,
Line 49, delete "Ann" and insert -- Are --, therefor.
Line 57, delete "FIG.5" and insert -- FIG. 10 --, therefor.
Line 59, insert -- ( -- before "back.".

Column 12,
Line 26, delete "Ti" and insert -- Tl --, therefor.
Line 27, after "WLa" insert -- , --.

Column 13,
Lines 4, 52 and 65, delete "MS" and insert -- M5 --, therefor.

Column 14,
Line 17, delete "Value" and insert -- value --, therefor.
Line 20, delete "Applicability" and insert -- Application --, therefor.

Column 15,
Line 13, delete "rearsteps" and insert -- rearstep --, therefor.

Signed and Sealed this

Sixth Day of September, 2005

JON W. DUDAS
*Director of the United States Patent and Trademark Office*